US010457046B2

(12) United States Patent
Kurokawa

(10) Patent No.: US 10,457,046 B2
(45) Date of Patent: Oct. 29, 2019

(54) NOZZLE SUBSTRATE, INK-JET PRINT HEAD, AND METHOD FOR PRODUCING NOZZLE SUBSTRATE

(71) Applicant: ROHM Co., LTD., Kyoto (JP)

(72) Inventor: Eitaro Kurokawa, Kyoto (JP)

(73) Assignee: ROHM CO., LTD., Kyoto (JP)

( * ) Notice: Subject to any disclaimer, the term of this patent is extended or adjusted under 35 U.S.C. 154(b) by 0 days.

(21) Appl. No.: 15/824,236

(22) Filed: Nov. 28, 2017

(65) Prior Publication Data

US 2018/0147844 A1 May 31, 2018

(51) Int. Cl.
*B41J 2/14* (2006.01)
*B41J 2/16* (2006.01)

(52) U.S. Cl.
CPC ..... *B41J 2/1433* (2013.01); *B41J 2/14233* (2013.01); *B41J 2/161* (2013.01); *B41J 2/164* (2013.01); *B41J 2/1609* (2013.01); *B41J 2/1626* (2013.01); *B41J 2/1631* (2013.01); *B41J 2/1632* (2013.01); *B41J 2/1635* (2013.01); *B41J 2/1642* (2013.01); *B41J 2/14274* (2013.01); *B41J 2002/14217* (2013.01); *B41J 2002/14241* (2013.01); *B41J 2002/14258* (2013.01); *B41J 2002/14475* (2013.01); *B41J 2002/14491* (2013.01)

(58) Field of Classification Search
CPC ..... B41J 2/1433; B41J 2/1632; B41J 2/1642; B41J 2/1631; B41J 2/1626; B41J 2/1635; B41J 2/161; B41J 2/1609; B41J 2/164; B41J 2/14233; B41J 2002/14491; B41J 2002/14475; B41J 2002/14241; B41J 2002/14258; B41J 2002/14217; B41J 2/14274
See application file for complete search history.

(56) References Cited

U.S. PATENT DOCUMENTS

2011/0074881 A1* 3/2011 Uchiyama ..... B41J 2/1606 347/45
2017/0165966 A1* 6/2017 Ito ..... B41J 2/1433

FOREIGN PATENT DOCUMENTS

JP 2015-091668 A 5/2015

* cited by examiner

*Primary Examiner* — Justin Seo
(74) *Attorney, Agent, or Firm* — Chip Law Group

(57) ABSTRACT

There is provided a nozzle substrate including a nozzle hole penetrating in a thickness direction. The nozzle substrate includes a main substrate including a first surface and a second surface, an adhesion layer formed on the second surface of the main substrate, and a water repellent film formed on a surface at an opposite side to the main substrate side of the adhesion layer. The nozzle hole includes a recessed part formed on the first surface of the main substrate, and an ink ejecting path formed on a bottom surface of the recessed part and penetrating a bottom wall of the recessed part. The ink ejecting path includes a first ink ejecting path, a second ink ejecting path, and a third ink ejecting path. An inner circumference surface of the third ink ejecting path is approximately perpendicular to the second surface of the main substrate.

6 Claims, 29 Drawing Sheets

NOZZLE SUBSTRATE, INK-JET PRINT HEAD, AND METHOD FOR PRODUCING NOZZLE SUBSTRATE

CROSS REFERENCE TO RELATED APPLICATIONS

This US. application claims priority benefit of Japanese Patent Application No. JP 2016-231797 filed in the Japan Patent Office on Nov. 29, 2016. Each of the above-referenced applications is hereby incorporated herein by reference in its entirety.

BACKGROUND

The present disclosure relates to a nozzle substrate, an ink-jet print head, and a method for producing a nozzle substrate.

Japanese Patent Laid-Open No. 2015-91668 (hereinafter referred to as Patent Document 1) discloses an ink-jet print head. The ink-jet print head of Patent Document 1 includes an actuator substrate (substrate) including a pressure chamber (pressure occurrence chamber) as the ink flow path, a movable film (elasticity film) formed on the actuator substrate, and a piezoelectric element disposed on the movable film. The ink-jet print head of Patent Document 1 further includes a nozzle substrate (nozzle plate) being joined to the lower surface of the actuator substrate and including a nozzle opening (nozzle hole) connected to the pressure chamber, and a protection substrate being joined to the upper surface of the actuator substrate and covering the piezoelectric element. The piezoelectric element includes a first electrode film (bottom portion electrode) formed on the movable film, a second electrode film (top portion electrode) disposed on the first electrode film, and a piezoelectric layer (piezoelectric film) held between them.

SUMMARY

The present inventors made a trial product of a nozzle substrate that is consisted of a silicon substrate, a silicon oxide film formed on one of the surfaces of the silicon substrate, and a water repellent film formed on the surface of the silicon oxide film, and that includes a nozzle hole penetrating in the thickness direction. The water repellent film is consisted of an organic film, such as fluorine-based polymer. The nozzle hole was formed as descried next. That is, at first, a stack body was prepared on which the water repellent film was formed on one of the surfaces of the silicon substrate through the silicon oxide film. Next, a resist mask having an opening corresponding to the nozzle hole was formed on the surface of the silicon substrate on which the water repellent film was not formed. While this resist mask was used as the mask, isotropic etching was performed on the silicon substrate, so that on this surface of the silicon substrate a recessed part was formed. Next, anisotropic etching was performed on the silicon substrate so that a first ink ejecting path whose transverse section was circular was formed on the bottom surface of the recessed part. Next, etching was performed from the first ink ejecting path side onto the silicon oxide film, so that a second ink ejecting path connected to the first ink ejecting path was formed on the silicon oxide film. Next, etching was performed from the second ink ejecting path side onto the water repellent film, so that a third ink ejecting path connected to the second ink ejecting path was formed on the water repellent film. Then, ashing processing was performed so that the resist mask was removed. On the third ink ejecting path, a portion opening to the surface of the water repellent film is the ink ejecting path.

It is preferable that the shape and size of the third ink ejecting path formed on the water repellent film is equal to the shape and size of the first ink ejecting path formed on the silicon substrate. However, in the case that the silicon oxidation film and the water repellent film are formed on one of the surfaces of the silicon substrate and then the nozzle hole penetrating them are formed as described above, the third ink ejecting path formed on the water repellent film has a shape expanding in the radial direction, compared with the first ink ejecting path formed on the silicon substrate. In other words, the inner circumference surface of the third ink ejecting path formed on the water repellent film in a plan view is depressed to the outside in the radial direction with respect to the inner circumference surface of the first ink ejecting path formed on the silicon substrate. This depression amount was equal to or more than 2 μm. In addition, the third ink ejecting path formed on the water repellent film happens to have a truncated cone shape expanding from the second ink ejecting path side to the ink ejecting path side.

The object of the present disclosure is to provide a nozzle substrate and a method for producing the nozzle substrate in which the shape and size of the transverse section of the ink ejecting path formed on the water repellent film is approximately equal to the shape and size of the transverse section of the ink ejecting path formed on the silicon substrate.

In addition, the object of the present disclosure is to provide an ink-jet print head including a nozzle substrate in which the shape and size of the transverse section of the ink ejecting path formed on the water repellent film is approximately equal to the shape and size of the transverse section of the ink ejecting path formed on the silicon substrate.

The nozzle substrate of the present disclosure is a nozzle substrate including a nozzle hole penetrating in a thickness direction. The nozzle substrate includes a main substrate including a first surface and a second surface, an adhesion layer formed on the second surface of the main substrate, and a water repellent film formed on a surface at an opposite side to the main substrate side of the adhesion layer. The nozzle hole includes a recessed part formed on the first surface of the main substrate, and an ink ejecting path formed on a bottom surface of the recessed part and penetrating a bottom wall of the recessed part. The ink ejecting path includes a first ink ejecting path penetrating the bottom wall of the recessed part of the main substrate, a second ink ejecting path connected to the first ink ejecting path and penetrating the adhesion layer, and a third ink ejecting path connected to the second ink ejecting path and penetrating the water repellent film. A transverse sectional area of the third ink ejecting path is approximately equal to a transverse sectional area of the first ink ejecting path, and an inner circumference surface of the third ink ejecting path is approximately perpendicular to the second surface of the main substrate.

This configuration implements a nozzle substrate in which the shape and size of the transverse section of the ink ejecting path formed on the water repellent film is approximately equal to the shape and size of the transverse section of the ink ejecting path formed on the silicon substrate.

In one embodiment of the present disclosure, an inner circumference surface of the third ink ejecting path formed on the water repellent film is, in a plan view, depressed to an outside with respect to an inner circumference surface of the first ink ejecting path formed on the main substrate, and a depression amount thereof is equal to or less than 1.5 μm.

In one embodiment of the present disclosure, the recessed part has a truncated cone shape whose transverse section is gradually reduced in size from the first surface side to the second surface side of the main substrate.

In one embodiment of the present disclosure, the recessed part has a solid cylindrical shape.

In one embodiment of the present disclosure, the main substrate is a silicon substrate, the adhesion layer is a SiOC layer, and the water repellent film is made of an FDTS film.

The ink-jet print head of the present disclosure includes an actuator substrate including an ink flow path with a pressure chamber, a movable film form layer including a movable film disposed on the pressure chamber and defining a top surface portion of the pressure chamber, a piezoelectric element formed on the movable film, and a nozzle substrate joined to an opposite side surface to a surface of the movable film side of the actuator substrate, defining a bottom surface portion of the pressure chamber, and including a nozzle hole connected to the pressure chamber. The nozzle substrate is the above-described nozzle substrate of the present disclosure, and the first surface of the main substrate is joined to the opposite side surface to the surface of the movable film side of the actuator substrate.

One embodiment of the present disclosure further includes a protection substrate joined to the actuator substrate so as to cover the piezoelectric element. The protection substrate includes a housing recessed portion opened toward the actuator substrate side and accommodating the piezoelectric element, and an ink supply path formed outside of one end of the housing recessed portion in the plan view and connected to one end portion of the ink flow path.

A method for producing a nozzle substrate of the present disclosure includes forming a main substrate having a first surface and a second surface and including a recessed part opened to the first surface and a first ink ejecting path penetrating a bottom wall of the recessed part and opened to the second surface, forming an adhesion layer and a water repellent film in this order on the second surface and an inner surface of the recessed part and an exposed surface of the main substrate including an inner surface of the first ink ejecting path, after a first support substrate is pasted on the first surface of the main substrate, separating the first support substrate from the main substrate, after a second support substrate is pasted to the second surface of the main substrate through the adhesion layer and the water repellent film, and forming a second ink ejecting path and a third ink ejecting path connected to the first ink ejecting path respectively on the adhesion layer and the water repellent film on the second surface, by using oxygen plasma ashing so as to remove the adhesion layer and the water repellent film formed on an inner surface of the recessed part of the main substrate and an inner surface of the first ink ejecting path.

This producing method can produce a nozzle substrate in which the shape and size of the transverse section of the ink ejecting path formed on the water repellent film is approximately equal to the shape and size of the transverse section of the ink ejecting path formed on the silicon substrate.

In one embodiment of the present disclosure, in the forming the adhesion layer and the water repellent film in this order, pasting of the first support substrate to the first surface of the main substrate is implemented by pasting the first support substrate on the first surface of the main substrate through a first heat-resistant protection tape and a first heat separation tape in this order, and, in the separating the first support substrate from the main substrate, pasting of the second support substrate to the second surface of the main substrate is implemented by pasting the second support substrate to a surface of the water repellent film on the second surface of the main substrate through a second heat-resistant protection tape and a second heat separation tape.

In one embodiment of the present disclosure, the recessed part has a truncated cone shape whose transverse section is gradually reduced in size from the first surface side to the second surface side of the main substrate.

In one embodiment of the present disclosure, the recessed part has a solid cylindrical shape.

In one embodiment of the present disclosure, the first, second, and third ink ejecting paths have circular transverse sections.

In one embodiment of the present disclosure, the main substrate is a silicon substrate, the adhesion layer is a SiOC layer, and the water repellent film is made of an FDTS film.

DETAILED DESCRIPTION OF THE PREFERRED EMBODIMENT

In the following description, an embodiment of the present disclosure will be described in detail by referring to the accompanying drawings.

Figure 1:
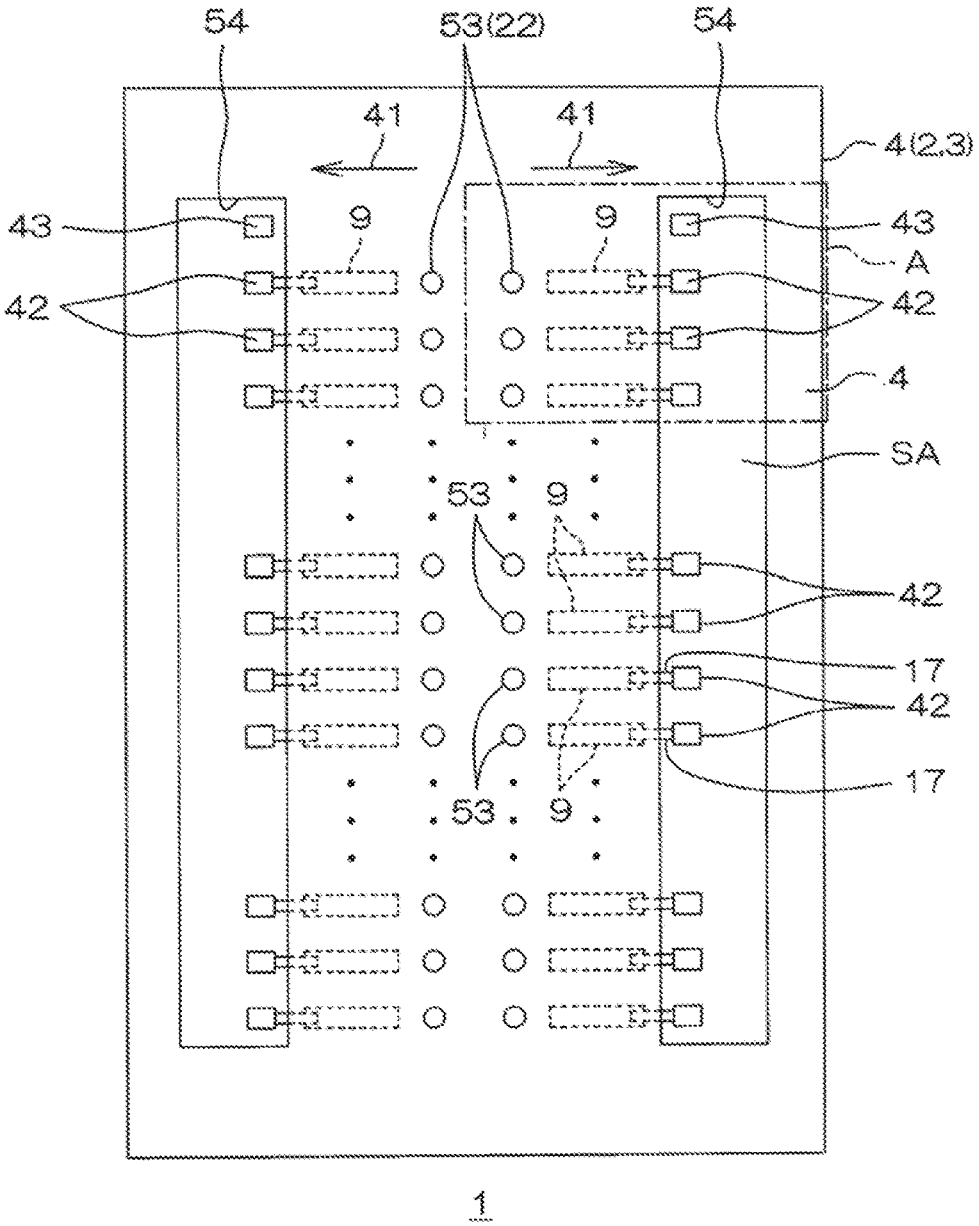
FIG. 1 is a schematic plan view for illustrating a configuration of an ink-jet print head according to an embodiment of the present disclosure.
Figure 2:
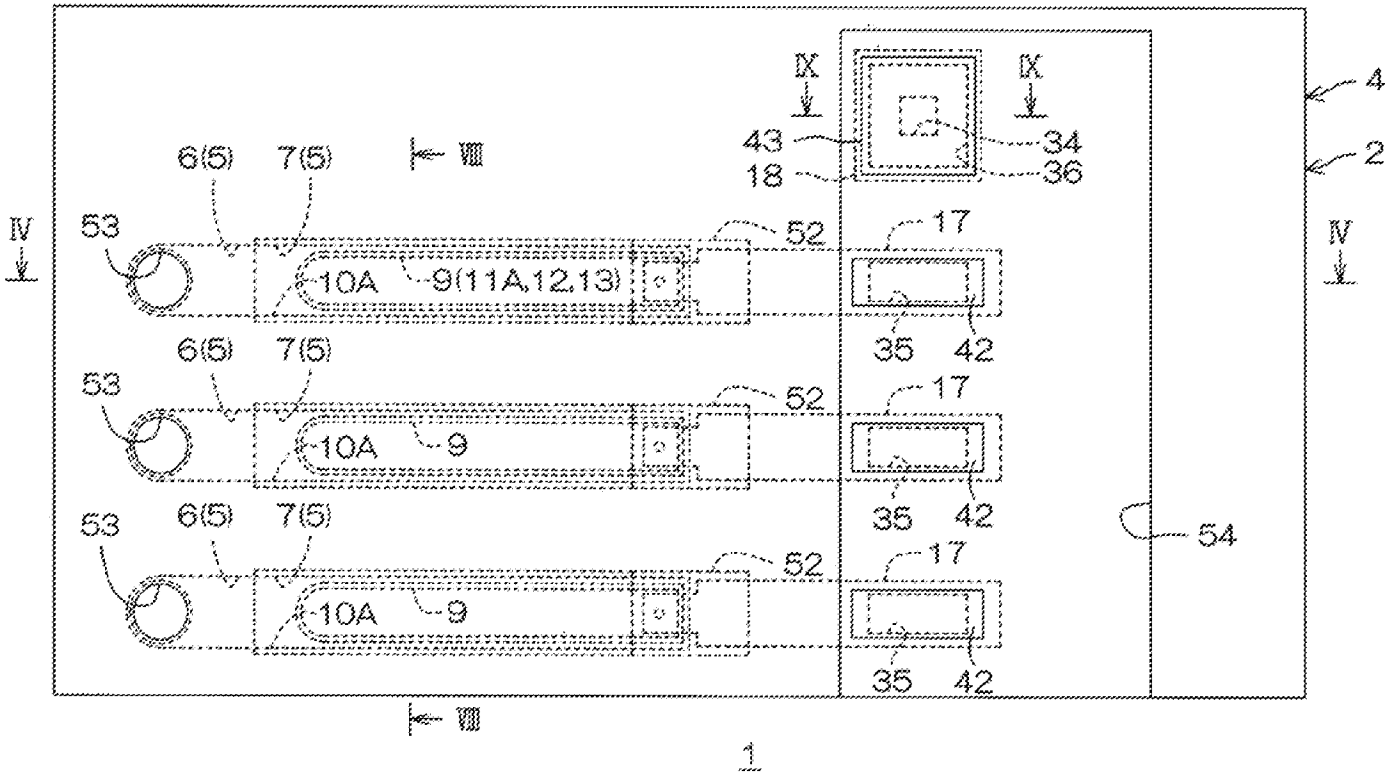
FIG. 2 is a schematic partially-enlarged plan view for enlarging and illustrating an A portion of FIG. 1 and is a plan view of including a protection substrate.
Figure 3:
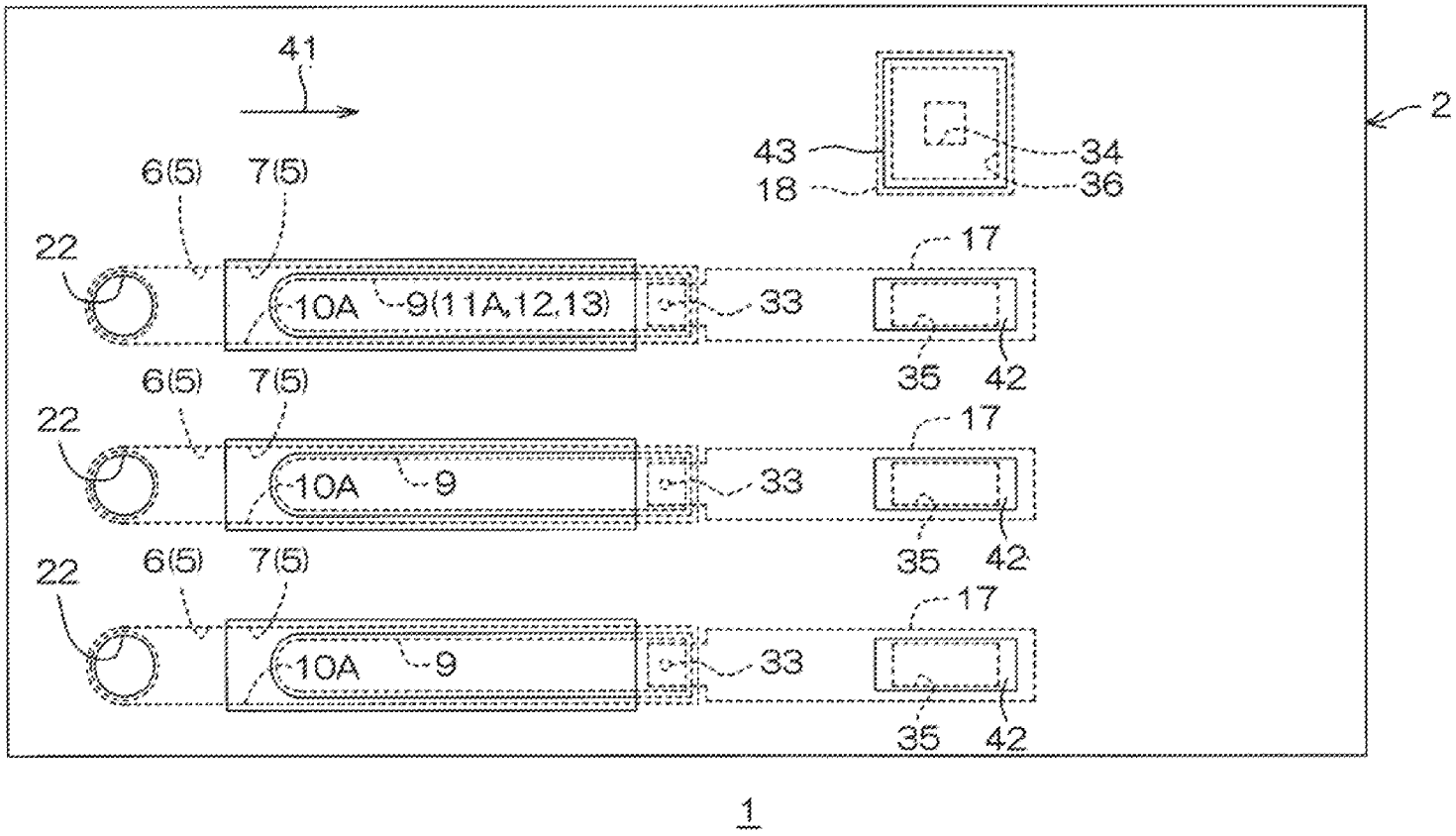
FIG. 3 is a schematic partially-enlarged plan view for enlarging and illustrating the A portion of FIG. 1 and is a plan view in which the protection substrate is omitted.
Figure 4:
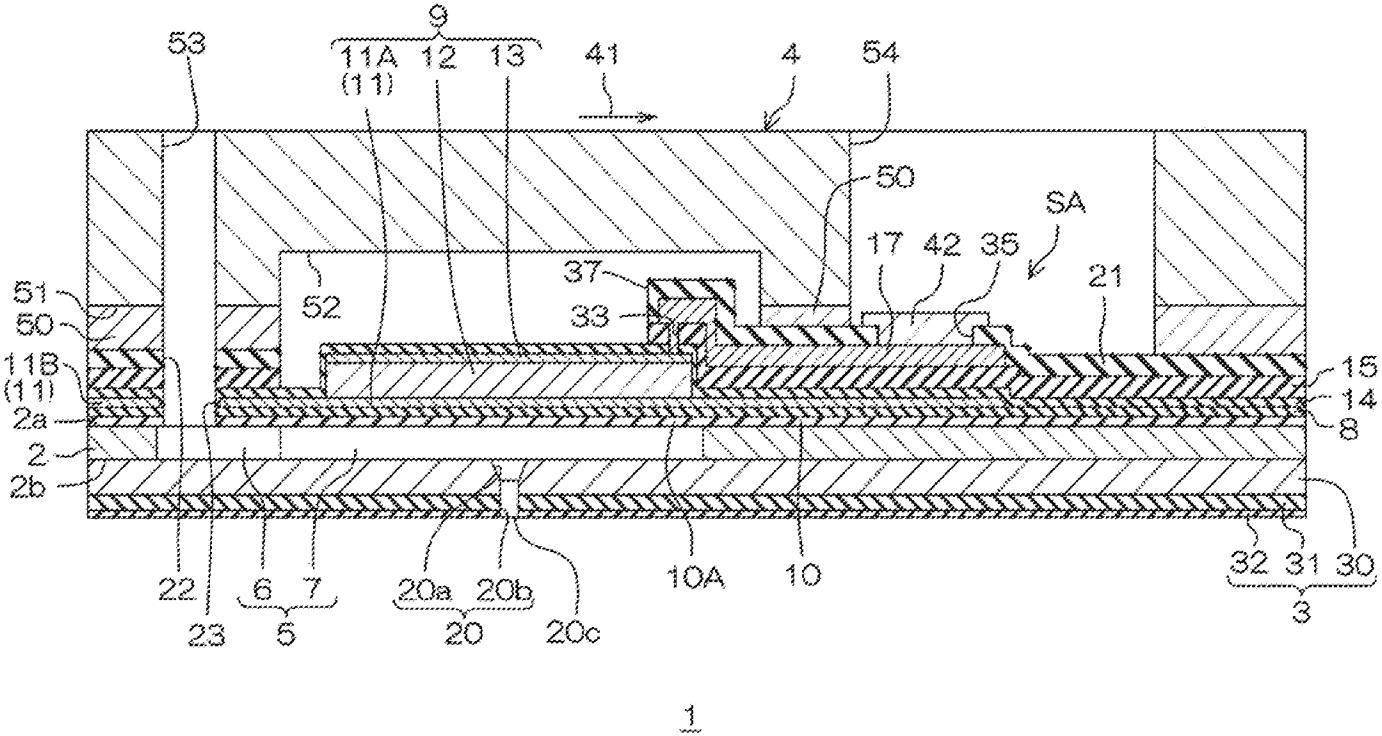
FIG. 4 is a schematic transverse-sectional view cut along IV-IV line of FIG. 2.
Figure 5:
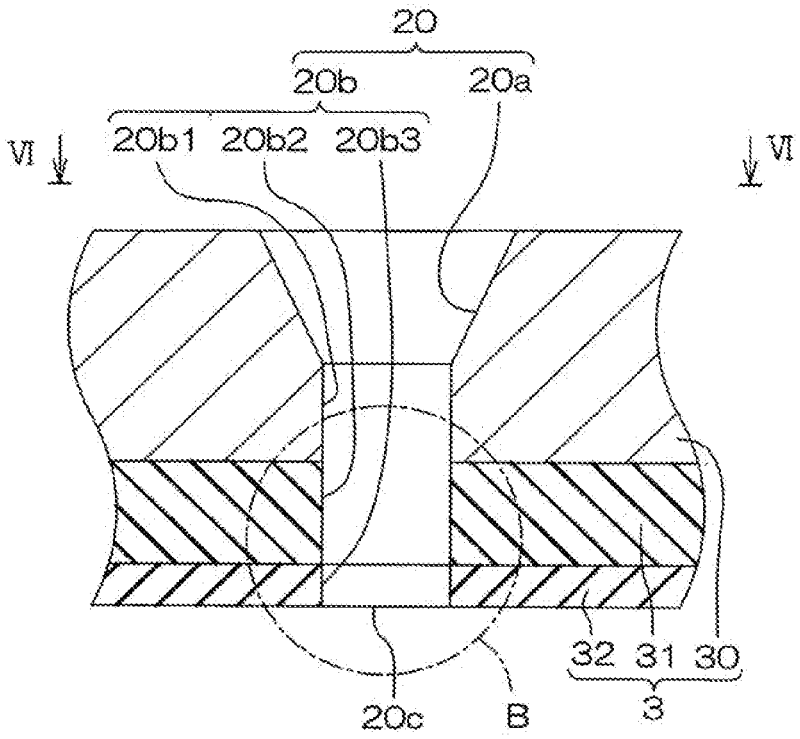
FIG. 5 is an enlarged transverse-sectional view for enlarging and illustrating a nozzle hole of FIG. 4.
Figure 6:
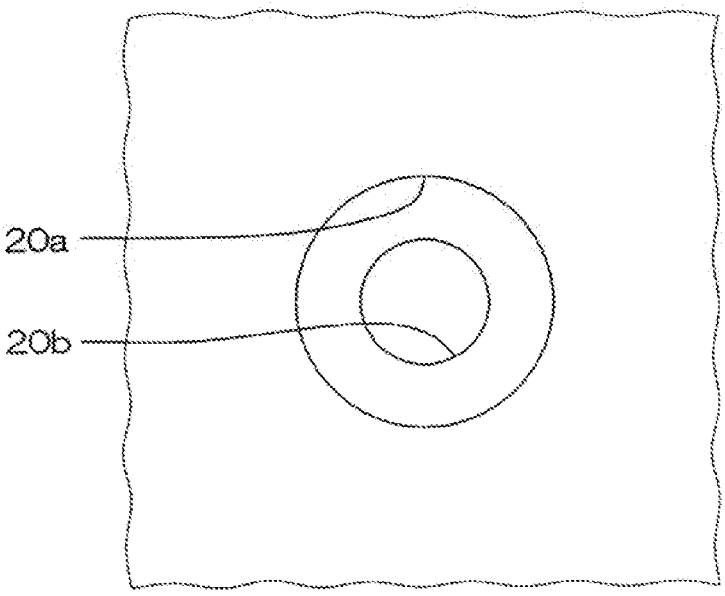
FIG. 6 is a plan view which is viewed from arrow VI-VI of FIG. 5.
Figure 7:
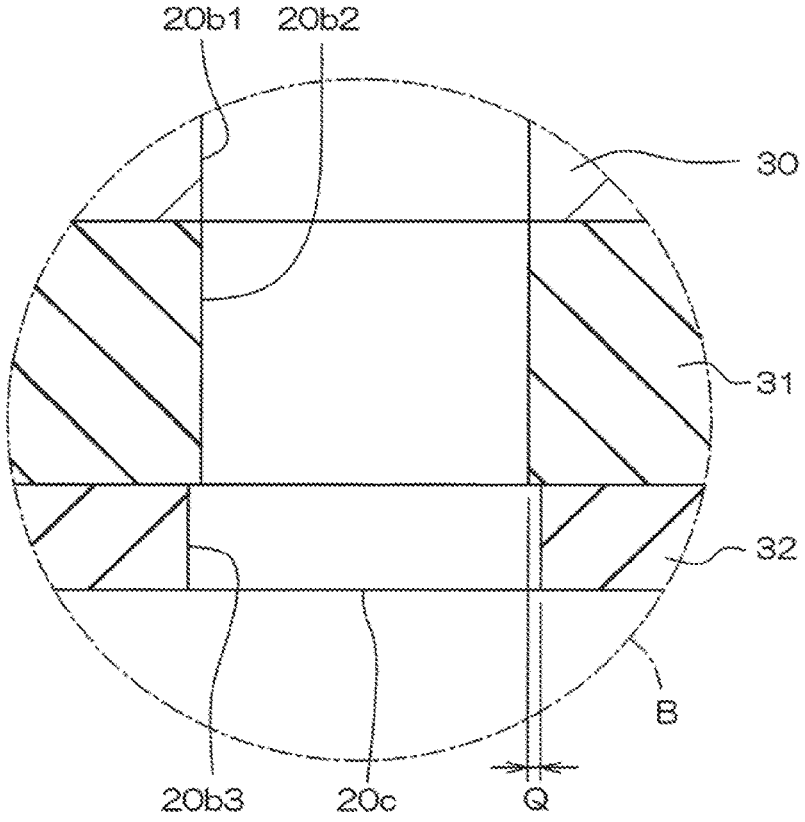
FIG. 7 is a partially enlarged transverse-sectional view that enlarges and illustrates a B portion of FIG. 5.
Figure 8:
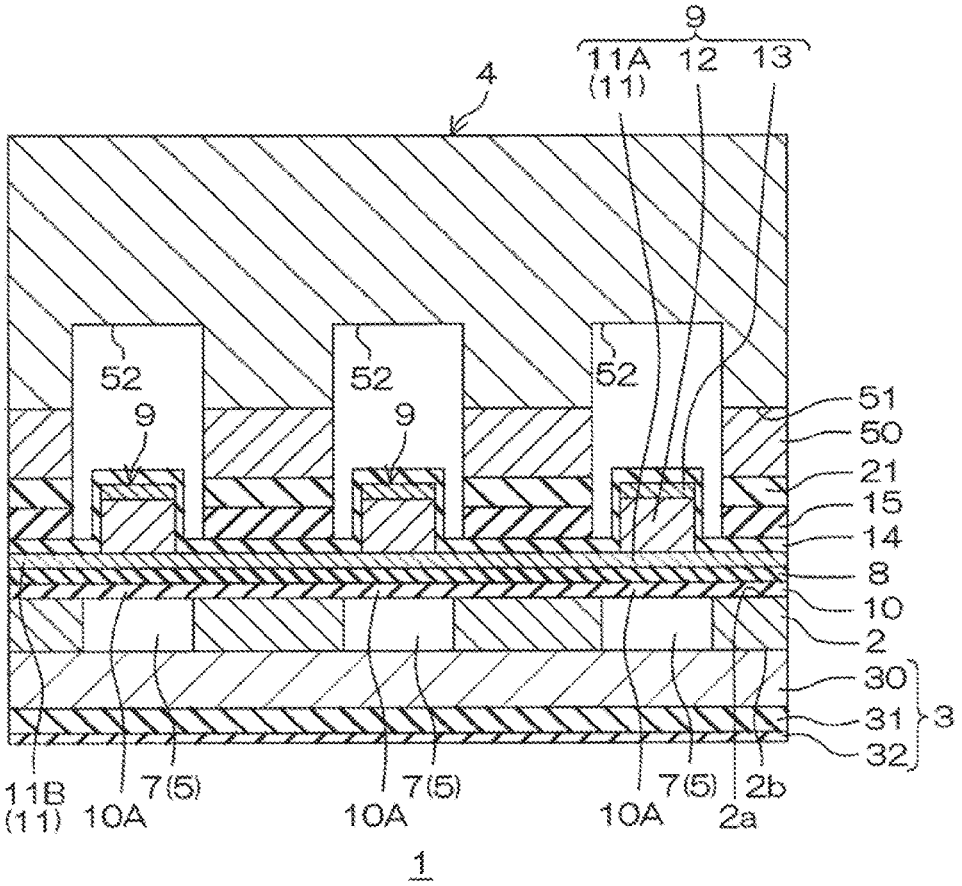
FIG. 8 is a schematic transverse sectional view cut along VIII-VIII line of FIG. 2.
Figure 9:
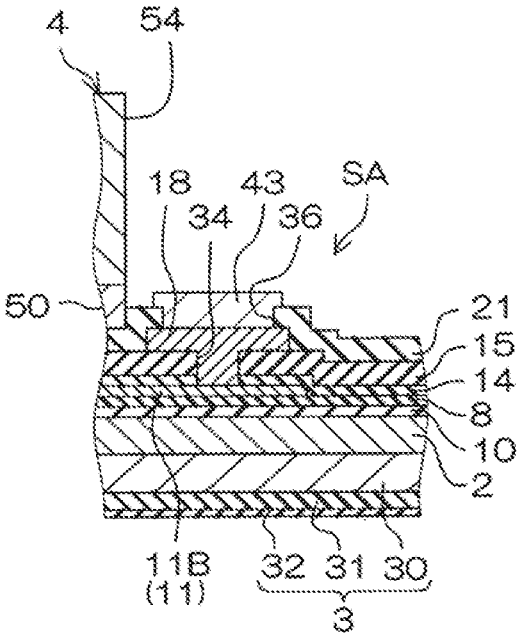
FIG. 9 is a schematic transverse-sectional view cut along IX-IX line of FIG. 2.

FIG. 1 is a schematic plan view for illustrating a configuration of an ink-jet print head according to an embodiment of the present disclosure. FIG. 2 is a schematic partially-enlarged plan view for enlarging and illustrating an A portion of FIG. 1 and is a plan view of including a protection substrate. FIG. 3 is a schematic partially-enlarged plan view for enlarging and illustrating the A portion of FIG. 1 and is a plan view in which the protection substrate is omitted. FIG. 4 is a schematic transverse-sectional view cut along IV-IV line of FIG. 2. FIG. 5 is an enlarged transverse-sectional view for enlarging and illustrating a nozzle hole of FIG. 4. FIG. 6 is a plan view which is viewed from arrow VI-VI of FIG. 5. FIG. 7 is a partially enlarged transverse-sectional view that enlarges and illustrates a B portion of FIG. 5. FIG. 8 is a schematic transverse sectional view cut along VIII-VIII line of FIG. 2. FIG. 9 is a schematic transverse-sectional view cut along IX-IX line of FIG. 2.

By referring to FIG. 4, the configuration of an ink-jet print head 1 will be schematically described.

The ink-jet print head 1 includes an actuator substrate assembly SA including an actuator substrate 2 and a piezoelectric element 9, a nozzle substrate 3, and a protection substrate 4. Hereinafter, the actuator substrate assembly SA will be referred to as a substrate assembly SA.

On a surface 2*a* of the actuator substrate 2, a movable film form layer 10 is stacked. On the actuator substrate 2, an ink flow path (ink accumulation) 5 is formed. The ink flow path 5 in the present embodiment is formed to penetrate the actuator substrate 2. The ink flow path 5 is formed to extend thin and long along an ink flowing direction 41 depicted by the arrow in FIG. 4. The ink flow path 5 is consisted of an ink inflowing portion 6 of the upstream side end (left end in FIG. 4) of the ink flowing direction 41 and a pressure chamber 7 connected to an ink inflowing portion 6. In FIG. 4, the boundary between the ink inflowing portion 6 and the pressure chamber 7 is depicted by a two-dot chain line.

The nozzle substrate 3 is, for example, consisted of a silicon (Si) substrate (main substrate) 30, an adhesion layer 31 formed on the opposite side surface (second surface) to the pressure chamber 7 of the silicon substrate 30, and a water repellent film 32 formed on the opposite side surface to the silicon substrate 30 of the adhesion layer 31. The adhesion layer 31 is a layer disposed for increasing the adhesion property of the water repellent film 32 with respect to the silicon substrate 30, and is consisted of an oxidation film or the like. In the present embodiment, the adhesion layer 31 is consisted of a silicon oxidation film (SiOC film) including carbon (C). The water repellent film 32 is consisted of an FDTS film (perfluorodecyltrichlorosilane film). In the present embodiment, the thickness of the silicon substrate 30 is approximately 50 μm, and the thicknesses of the stack film of the adhesion layer 31 and the water repellent film 32 are approximately 75 to 150 Å.

The nozzle substrate 3 is stacked on a rear surface 2*b* of the actuator substrate 2 in a state that the surface (first surface) at the silicon substrate 30 side faces to the rear surface 2*b* of the actuator substrate 2. With the actuator substrate 2 and the movable film form layer 10, the nozzle substrate 3 defines the ink flow path 5. More specifically, the nozzle substrate 3 defines the bottom surface portion of the ink flow path 5.

By referring to FIG. 4 to FIG. 7, a nozzle hole 20 is formed on the nozzle substrate 3. The nozzle hole 20 is consisted of a recessed part 20*a* fronting the pressure chamber 7, and an ink ejecting path 20*b* formed on the bottom surface of the recessed part 20*a*. The recessed part 20*a* is formed on the surface at the actuator substrate 2 side of the silicon substrate 30. The ink ejecting path 20*b* penetrates the bottom wall of the recessed part 20*a* and includes an ink ejecting port 20*c* at the opposite side to the pressure chamber 7.

As illustrated in FIG. 5, the ink ejecting path 20*b* is consisted of a first ink ejecting path 20*b*1 penetrating the recessed part 20*a* of the silicon substrate 30, a second ink ejecting path 20*b*2 connected to the first ink ejecting path 20*b*1 and penetrating the adhesion layer 31, and a third ink ejecting path 20*b*3 connected to the second ink ejecting path 20*b*2 and penetrating the water repellent film 32. The depth of the recessed part 20*a* formed on the silicon substrate 30 is approximately 30 μm, and the depth of the first ink ejecting path 20*b*1 formed on the silicon substrate 30 is approximately 20 μm. When a volume change in the pressure chamber 7 occurs, the ink accumulated in the pressure chamber 7 passes the ink ejecting path 20*b* and is ejected from the ink ejecting port 20*c*.

In the present embodiment, the recessed part 20*a* is formed to have a truncated cone shape whose transverse section is gradually reduced in size from the surface of the silicon substrate 30 to the adhesion layer 31 side. The ink ejecting path 20*b* has a solid cylindrical shape. In other words, the ink ejecting path 20*b* is consisted of a straight hole whose transverse section is circular. The transverse sectional area of the third ink ejecting path 20*b*3 formed on the water repellent film 32 is approximately equal to the transverse sectional area of the first ink ejecting path 20*b*1 formed on the silicon substrate 30. In addition, the inner circumference surface of the third ink ejecting path 20*b*3 is approximately perpendicular to the surface of the silicon substrate 30 (surface of the actuator substrate 2 side and rear surface at the opposite side). As illustrated in FIG. 7, the third ink ejecting path 20*b*3 has a shape wide a little bit in the radial direction, compared to the first ink ejecting path 20b1. In other words, the inner circumference surface of the third ink ejecting path 20b3 in a plan view is depressed a little bit to the outside in the radial direction (lateral direction) with respect to the inner circumference surface of the first ink ejecting path 20b1. This depression amount Q is equal to or less than 1.5 μm.

The top wall portion of the pressure chamber 7 in the movable film form layer 10 configures a movable film 10A. The movable film 10A (movable film form layer 10) is, for example, consisted of a silicon oxide (SiO2) film formed on the actuator substrate 2. The movable film 10A (movable film form layer 10) may be consisted of, for example, a stack film including a silicon (Si) film formed on the actuator substrate 2, a silicon oxide (SiO2) film formed on the silicon film, and a silicon nitride (SiN) film formed on the silicon oxide film. In this specification, the movable film 10A means a top wall portion of the movable film form layer 10 that defines the top surface portion of the pressure chamber 7. Thus, portions of the movable film form layer 10 other than the top wall portion of the pressure chamber 7 do not configure the movable film 10A.

The thickness of the movable film 10A is, for example, 0.4 to 2 μm. In the case that the movable film 10A is consisted of the silicon oxide film, the thickness of the silicon oxide film may be approximately 1.2 μm. In the case that the movable film 10A is consisted of a stack film including a silicon film, a silicon oxide film, and a silicon nitride film, each thickness of the silicon film, the silicon oxide film, and the silicon nitride film may be approximately 0.4 μm.

The pressure chamber 7 is defined by the movable film 10A, the actuator substrate 2, and the nozzle substrate 3, and is formed in the present embodiment to have an approximately rectangular parallelepiped shape. The length of the pressure chamber 7 may be, for example, approximately 800 μm, and the width may be approximately 55 μm. The ink inflowing portion 6 communicates with one end portion in the longitudinal direction of the pressure chamber 7.

A metal barrier film 8 is formed on the surface of the movable film form layer 10. The metal barrier film 8 is, for example, made of Al2O3 (alumina). The thickness of the metal barrier film 8 is approximately 50 to 100 nm. A piezoelectric element 9 is disposed on the surface of the metal barrier film 8 at the above position of the movable film 10A. The piezoelectric element 9 includes a bottom portion electrode 11 formed on the metal barrier film 8, a piezoelectric film 12 formed on the bottom portion electrode 11, and a top portion electrode 13 formed on the piezoelectric film 12. In other words, the piezoelectric element 9 is configured by the piezoelectric film 12 held upward and downward with the top portion electrode 13 and the bottom portion electrode 11.

The top portion electrode 13 may be a single film made of platinum (Pt), or, for example, may include a stack structure in which conductive oxidation film (for example, IrO2 (iridium oxide) film) and metal film (for example, Ir (iridium) film) are stacked. The thickness of the top portion electrode 13 may be, for example, approximately 0.2 μm.

As for the piezoelectric film 12, it is possible to apply PZT (PbZrxTi1-xO3: lead zirconate titanate) film formed by sol-gel method or spattering method, for example. The piezoelectric film 12 as described above is consisted of a sintered body of the metal oxide crystal. The piezoelectric film 12 is formed to have a shape similar to the top portion electrode 13 in a plan view. The thickness of the piezoelectric film 12 is approximately 1 μm. It is preferable to make the whole thickness of the movable film 10A be approximately equal to the thickness of the piezoelectric film 12, or be approximately ⅔ of the thickness of the piezoelectric film 12. Above-described metal barrier film 8 mainly suppresses metal elements (Pb, Zr, and Ti in the case that the piezoelectric film 12 is PZT) from breaking out from the piezoelectric film 12 so as to keep the piezoelectric property of the piezoelectric film 12 in a satisfactory manner, and suppresses the metal from being diffused on the movable film 10A at the film formation time of the piezoelectric film 12. The metal barrier film 8 further has a function of suppressing the characteristic degradation caused by hydrogen reduction on the piezoelectric film 12.

The bottom portion electrode 11 has a two-layer structure in which, for example, Ti (titanium) film and Pt (platinum) film are stacked in order from the metal barrier film 8 side. Outside of this, the bottom portion electrode 11 may be formed to be consisted of a single film, such as Au (aurum) film, Cr (chromium) layer, Ni (nickel) layer, and the like. The bottom portion electrode 11 includes a main electrode portion 11A coming into contact with the lower surface of the piezoelectric film 12, and an extending portion 11B extending to a region outside the piezoelectric film 12. The thickness of the bottom portion electrode 11 may be, for example, approximately 0.2 μm.

A hydrogen barrier film 14 is formed on the piezoelectric element 9, on the extending portion 11B of the bottom portion electrode 11, and on the metal barrier film 8. The hydrogen barrier film 14 is, for example, made of Al2O3 (alumina). The thickness of the hydrogen barrier film 14 is approximately 50 to 100 nm. The hydrogen barrier film 14 is disposed to suppress the characteristic degradation caused by hydrogen reduction on the piezoelectric film 12.

An insulation film 15 is stacked on the hydrogen barrier film 14. The insulation film 15 is, for example, made of SiO2, low hydrogen SiN, and the like. The thickness of the insulation film 15 is approximately 500 nm. On the insulation film 15, a top portion wiring 17 and a bottom portion wiring 18 (see FIG. 2 and FIG. 9) are formed. These wirings may be made of metal material including Al (aluminum). The thickness of these wirings is, for example, approximately 1000 nm (1 μm).

One end portion of the top portion wiring 17 is disposed above the one end portion of the top portion electrode 13 (downstream side end in the ink flowing direction 41). Between the top portion wiring 17 and the top portion electrode 13, a contact hole 33 is formed that penetrates the hydrogen barrier film 14 and the insulation film 15 in sequence. One end portion of the top portion wiring 17 gets into the contact hole 33, and is coupled to the top portion electrode 13 in the contact hole 33. The top portion wiring 17 extends from a part above the top portion electrode 13, across the outer edge of the pressure chamber 7, to the outside of the pressure chamber 7. The bottom portion wiring 18 will be described later.

On the insulation film 15, a passivation film 21 is formed that covers the top portion wiring 17, the bottom portion wiring 18, and the insulation film 15. The passivation film 21 is, for example, consisted of SiN (silicon nitride). The thickness of the passivation film 21 is, for example, approximately 800 nm.

On the passivation film 21, a pad opening 35 is formed that make the top portion wiring 17 be partially exposed. The pad opening 35 is formed on the outside region of the pressure chamber 7. For example, it is formed on the distal end portion of the top portion wiring 17 (opposite side end of the contact portion to the top portion electrode 13). On the passivation film 21, a pad for the top portion electrode 42 is formed that covers the pad opening 35. The pad for the top portion electrode 42 gets into the pad opening 35, and is coupled to the top portion wiring 17 in the pad opening 35. At the bottom portion wiring 18, a pad for the bottom portion electrode 43 (see FIG. 2 and FIG. 9) is disposed. The pad for the bottom portion electrode 43 will be described later.

At a position corresponding to an end at the ink inflowing portion 6 side on the ink flow path 5, a through hole for the ink supply 22 is formed that penetrates the passivation film 21, the insulation film 15, the hydrogen barrier film 14, the bottom portion electrode 11, the metal barrier film 8, and the movable film form layer 10. On the bottom portion electrode 11, a great through hole 23 is formed, which includes a through hole for the ink supply 22 and is larger than the through hole for the ink supply 22. A hydrogen barrier film 14 gets into gaps of the through hole 23 and the through hole for the ink supply 22 of the bottom portion electrode 11. The through hole for the ink supply 22 communicates with the ink inflowing portion 6.

The protection substrate 4 is, for example, consisted of a silicon substrate. The protection substrate 4 is disposed on the substrate assembly SA to cover the piezoelectric element 9. The protection substrate 4 is joined to the substrate assembly SA through an adhesive agent 50. The protection substrate 4 includes a housing recessed portion 52 on a facing surface 51 that faces to the substrate assembly SA. The piezoelectric element 9 is accommodated in the housing recessed portion 52. Further, on the protection substrate 4, an ink supply path 53 connected to the through hole for the ink supply 22 and an opening 54 for making the pads 42 and 43 be exposed are formed. The ink supply path 53 and the opening 54 penetrate the protection substrate 4. On the protection substrate 4, an ink tank (not illustrated) storing ink is disposed.

The piezoelectric element 9 is formed at a position facing to the pressure chamber 7 between the movable film 10A and the metal barrier film 8. That is, the piezoelectric element 9 is formed to come into contact with an opposite side surface to the pressure chamber 7 of the metal barrier film 8. Ink is supplied from the ink tank to the pressure chamber 7, through the ink supply path 53, the through hole for the ink supply 22, and the ink inflowing portion 6, so that the ink is filled in the pressure chamber 7. The movable film 10A defines the top surface portion of the pressure chamber 7 and fronts the pressure chamber 7. The movable film 10A is supported by portions around the pressure chamber 7 on the actuator substrate 2, and has flexibility to deform in a direction facing to the pressure chamber 7 (in other words, thickness direction of the movable film 10A).

The bottom portion wiring 18 (see FIG. 2 and FIG. 9) and the top portion wiring 17 are coupled to a drive circuit (not illustrated). Specifically, the pad for the top portion electrode 42 and the drive circuit are coupled through a coupling metal member (not illustrated). The pad for the bottom portion electrode 43 (see FIG. 2 and FIG. 9) and the drive circuit are coupled through a coupling metal member (not illustrated). When drive voltage is applied from the drive circuit to the piezoelectric element 9, the piezoelectric film 12 is deformed by inverse piezoelectric effect. This ensures that, the piezoelectric element 9 and the movable film 10A are deformed to cause volume change in the pressure chamber 7, so as to make the ink in the pressure chamber 7 be pressed. The pressed ink is ejected as microdroplets from the ink ejecting port 20*c* through the ink ejecting path 20*b*.

By referring to FIG. 1 to FIG. 9, the configuration of the ink-jet print head 1 will be described in more detail below. in the following description, the left side of FIG. 1 is referred to as "left," the right side of FIG. 1 is referred to as "right," the bottom side of FIG. 1 is referred to as "front," and the top side of FIG. 1 is referred to as "rear."

As illustrated in FIG. 1, the plan view shape of the ink-jet print head 1 is rectangular and longer in the front and rear direction. In the present embodiment, the plane shapes and sizes of the actuator substrate 2, the protection substrate 4, and the nozzle substrate 3 are approximately similar to the plane shape and size of the ink-jet print head 1.

On the actuator substrate 2, rows each including a plurality of piezoelectric elements 9 and arranged in a stripe manner with intervals in the front and rear direction in the plan view (hereinafter, referred to as "piezoelectric element array") are disposed with intervals in the lateral direction so that a plurality of rows are disposed. In the present embodiment, two rows of the piezoelectric element arrays are disposed for the sake of description.

As illustrated in FIG. 2 and FIG. 3, an ink flow path 5 (pressure chamber 7) is formed on the actuator substrate 2, every piezoelectric element 9. Thus, on the actuator substrate 2, two rows of the ink flow path array (pressure chamber array) consisted of a plurality of ink flow paths 5 (pressure chambers 7) arranged in a stripe manner with intervals in the front and rear direction in the plan view are disposed with intervals in the lateral direction.

In FIG. 1, a pattern of the ink flow path array corresponding to the left-side piezoelectric element array and a pattern of the ink flow path array corresponding to the right side piezoelectric element array are left-right symmetry with respect to the line passing the center between these rows. Thus, regarding the ink flow path 5 contained in the left-side ink flow path array, the ink inflowing portion 6 is positioned at the right side with respect to the pressure chamber 7, but regarding the ink flow path 5 contained in the right-side ink flow path array, the ink inflowing portion 6 is positioned at the left side with respect to the pressure chamber 7. Thus, the ink flowing direction 41 of the left-side ink flow path array is inverse to the ink flowing direction 41 of the right-side ink flow path array.

The through hole for the ink supply 22 is disposed by a plurality of ink flow paths 5 in each ink flow path array. The through hole for the ink supply 22 is disposed on the ink inflowing portion 6. Thus, the through hole for the ink supply 22 with respect to the ink flow path 5 contained in the left-side ink flow path array is disposed at the right end of the ink flow path 5, and the through hole for the ink supply 22 with respect to the ink flow path 5 contained in the right-side ink flow path array is disposed at the left end of the ink flow path 5.

In each ink flow path array, a plurality of ink flow paths 5 are formed and spaced away by equal intervals of small intervals (for example, approximately 30 to 350 μm) in their own width directions. Each ink flow path 5 extends thin and long along the ink flowing direction 41. The ink flow path 5 is consisted of the ink inflowing portion 6 connected to the through hole for the ink supply 22 and the pressure chamber 7 connected to the ink inflowing portion 6. In the plan view, the pressure chamber 7 has a rectangular shape extending thin and long along the ink flowing direction 41. That is, the top surface portion of the pressure chamber 7 includes two side edges along the ink flowing direction 41 and two end edges along a direction orthogonal to the ink flowing direction 41. In the plan view, the width of the ink inflowing portion 6 is approximately the same as the width of the pressure chamber 7. The inner surface of the end portion at the opposite side to the pressure chamber 7 on the ink inflowing portion 6 is formed to be semicircular in the plan view. In the plan view, the through hole for the ink supply 22 is circular (see FIG. 3, in particular).

In the plan view, the piezoelectric element 9 has a rectangular shape long in the longitudinal direction of the pressure chamber 7 (movable film 10A). The length of the piezoelectric element 9 in the longitudinal direction is shorter than the length of the pressure chamber 7 (movable film 10A) in the longitudinal direction. As illustrated in FIG. 3, the both end edges along the short side direction of the piezoelectric element 9 are individually disposed at the inner sides of the corresponding both end edges of the movable film 10A spaced away by predetermined intervals. In addition, the width of the piezoelectric element 9 in the short side direction is narrower than the width of the movable film 10A in the short side direction. The both sides edges along the longitudinal direction of the piezoelectric element 9 are disposed at the inner sides of the corresponding both sides edges of the movable film 10A spaced away by predetermined intervals.

The bottom portion electrode 11 is formed on almost all regions of the surface of the movable film form layer 10, other than the circumference edge portion of the surface of the movable film form layer 10. The bottom portion electrode 11 is a common electrode shared for the plurality of piezoelectric elements 9. The bottom portion electrode 11 includes a main electrode portion 11A, which configures the piezoelectric element 9 and has a rectangular shape in the plan view, and includes an extending portion 11B, which is drawn out from the main electrode portion 11A in a direction along the surface of the movable film form layer 10 and extends toward the outside of the circumference edge of the top surface portion of the pressure chamber 7.

The length of the main electrode portion 11A in the longitudinal direction is shorter than the length of the movable film 10A in the longitudinal direction. The both end edges of the main electrode portion 11A are individually disposed at the inner sides of the corresponding both end edges of the movable film 10A spaced away by predetermined intervals. In addition, the width of the main electrode portion 11A in the short side direction is narrower than the width of the movable film 10A in the short side direction. The both sides edges of the main electrode portion 11A are disposed at the inner sides of the corresponding both sides edges of the movable film 10A spaced away by predetermined intervals. The extending portion 11B is a region where the main electrode portion 11A is removed from the whole region of the bottom portion electrode 11.

In the plan view, the top portion electrode 13 is formed to have a rectangular shape in the same pattern as the main electrode portion 11A of the bottom portion electrode 11. In other words, the length of the top portion electrode 13 in the longitudinal direction is shorter than the length of the movable film 10A in the longitudinal direction. The both end edges of the top portion electrode 13 are individually disposed at the inner sides of the corresponding both end edges of the movable film 10A spaced away by predetermined intervals. In addition, the width of the top portion electrode 13 in the short side direction is narrower than the width of the movable film 10A in the short side direction. The both sides edges of the top portion electrode 13 are disposed at the inner sides of the corresponding both sides edges of the movable film 10A spaced away by predetermined intervals.

In the plan view, the piezoelectric film 12 is formed to have a rectangular shape in the same pattern as the top portion electrode 13. In other words, the length of the piezoelectric film 12 in the longitudinal direction is shorter than the length of the movable film 10A in the longitudinal direction. The both end edges of the piezoelectric film 12 are individually disposed at the inner sides of the corresponding both end edges of the movable film 10A spaced away by predetermined intervals. In addition, the width of the piezoelectric film 12 in the short side direction is narrower than the width of the movable film 10A in the short side direction. The both sides edges of the piezoelectric film 12 are disposed at the inner side of the corresponding both sides edges of the movable film 10A spaced away by predetermined intervals. The lower surface of the piezoelectric film 12 comes into contact with the upper surface of the main electrode portion 11A of the bottom portion electrode 11, and the upper surface of the piezoelectric film 12 comes into contact with the lower surface of the top portion electrode 13.

The top portion wiring 17 extends from the upper surface of one end portion (downstream-side end of the ink flowing direction 41) of the piezoelectric element 9 along the end surface of the piezoelectric element 9 continuing to the upper surface, and further extends along the surface of the extending portion 11B of the bottom portion electrode 11 in a direction along the ink flowing direction 41. The distal end portion of the top portion wiring 17 is disposed in the opening 54 of the protection substrate 4.

On the passivation film 21, a pad opening for the top portion electrode 35 is formed that makes the center portion of the distal end portion surface of the top portion wiring 17 be exposed. On the passivation film 21, a pad for the top portion electrode 42 is disposed to cover the pad opening for the top portion electrode 35. The pad for the top portion electrode 42 is coupled to the top portion wiring 17 in the pad opening for the top portion electrode 35. As illustrated in FIG. 1, the plurality of pads for the top portion electrode 42 corresponding to the plurality of piezoelectric elements 9 in the left-side piezoelectric element array are disposed, in plan view, in a single-line manner in the front and rear direction at the left side of the left-side piezoelectric element array. In addition, the plurality of pads for the top portion electrode 42 corresponding to the plurality of piezoelectric elements 9 in the right-side piezoelectric element array are disposed, in plan view, in a single-line manner in the front and rear direction at the right side of the right-side piezoelectric element array.

By referring to FIG. 1, FIG. 2, FIG. 3, and FIG. 9, the bottom portion wirings 18 in the plan view are individually disposed at the rear position of the left-side pad array for the top portion electrode and at the rear position of the right-side pad array for the top portion electrode. In the plan view, the bottom portion wiring 18 has a square shape. Downward the bottom portion wiring 18, the extending portion 11B of the bottom portion electrode 11 exists. Between the bottom portion wiring 18 and the extending portion 11B of the bottom portion electrode 11, a contact hole 34 is formed that penetrates the hydrogen barrier film 14 and the insulation film 15 in sequence. The bottom portion wiring 18 gets into the contact hole 34 and is coupled to the extending portion 11B of the bottom portion electrode 11 in the contact hole 34.

On the passivation film 21, a pad opening 36 is formed that makes the center portion of the surface of the bottom portion wiring 18 be exposed. On the passivation film 21, a pad for the bottom portion electrode 43 is formed to cover the pad opening 36. The pad for the bottom portion electrode 43 gets into the pad opening 36, and is coupled to the bottom portion wiring 18 in the pad opening 36.

On the protection substrate 4, as illustrated in FIG. 1, FIG. 2, and FIG. 4, a plurality of ink supply paths 53 connected to the plurality of through holes for the ink supply 22 with respect to the left-side ink flow path array (hereinafter, occasionally referred to as "first ink supply path 53") and a plurality of ink supply paths 53 connected to the plurality of through holes for the ink supply 22 with respect to the right-side ink flow path array (hereinafter, occasionally referred to as "second ink supply path 53") are formed. In the plan view, the first ink supply paths 53 are disposed at positions shifted to the left side with respect to the width center of the protection substrate 4 and are arranged in a single-line manner with intervals in the front and rear direction. In the plan view, the second ink supply paths 53 are disposed at positions shifted to the right side with respect to the width center of the protection substrate 4, and are arranged in a single-line manner with intervals in the front and rear direction. In the plan view, the ink supply path 53 is circular in the same pattern as the through hole for the ink supply 22 at the actuator substrate 2 side. In the plan view, the ink supply path 53 matches the through hole for the ink supply 22.

In addition, on the protection substrate 4, an opening 54 is formed that makes all the pads for the top portion electrode 42 corresponding to the left-side piezoelectric element array and the left-side pads for the bottom portion electrode 43 be exposed. In addition, on the protection substrate 4, an opening 54 is formed that makes all the pads for the top portion electrode 42 corresponding to the right-side piezoelectric element array and the right-side pad for the bottom portion electrode 43 be exposed. In the plan view, these openings 54 have rectangular shapes long in the front and rear direction.

Figure 12:
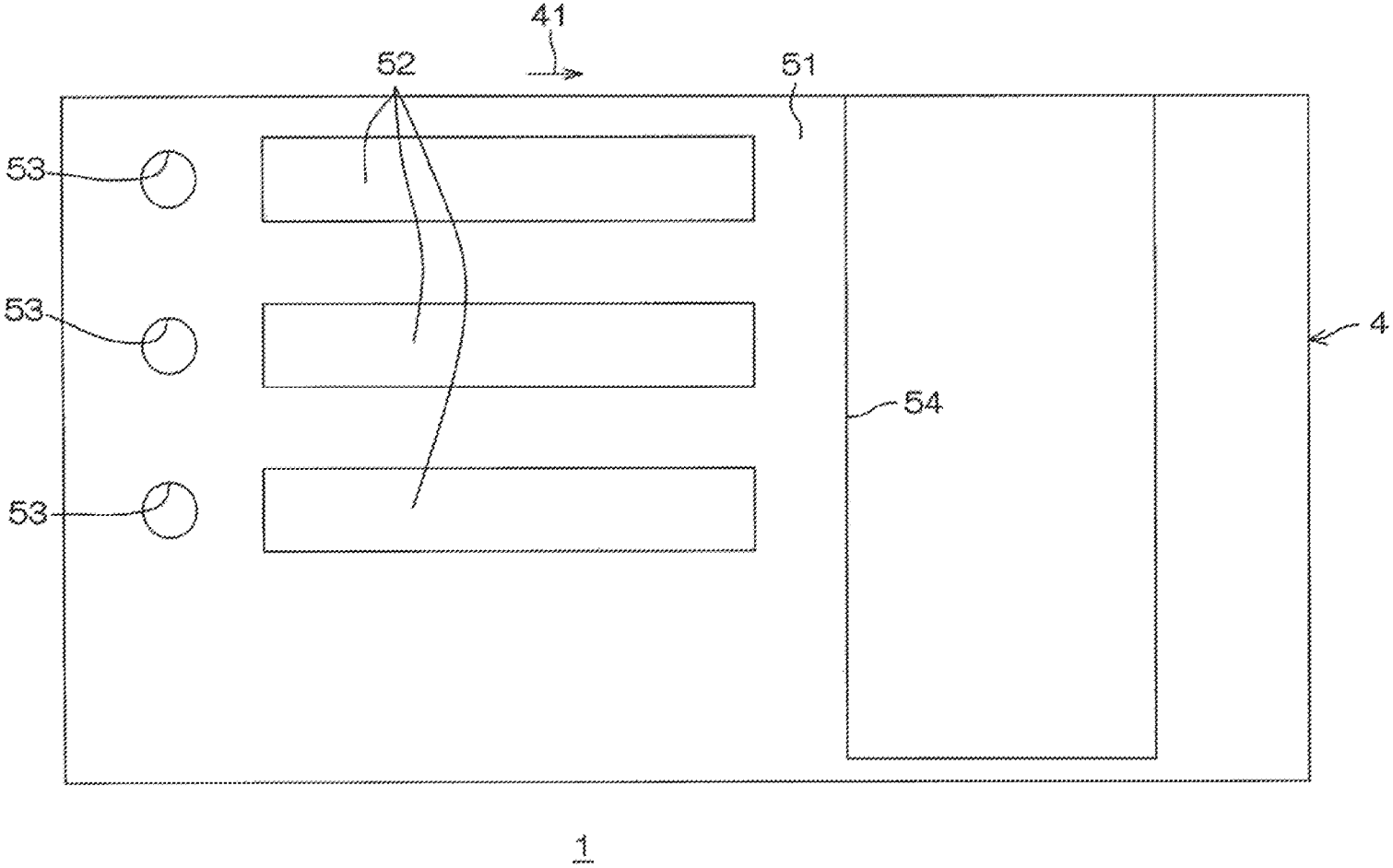
FIG. 12 is a bottom view of a region of the protection substrate depicted in FIG. 2.

FIG. 12 is a bottom view of a region of the protection substrate depicted in FIG. 2.

As illustrated in FIG. 4, FIG. 8, and FIG. 12, on the facing surface 51 of the protection substrate 4, housing recessed portions 52 are individually formed at positions facing to the piezoelectric element 9 in each piezoelectric element array. The ink supply path 53 is disposed at the upstream side in the ink flowing direction 41 with respect to each housing recessed portion 52, and the opening 54 is disposed at the downstream side. In the plan view, each housing recessed portion 52 is formed to have a rectangular shape a little bit larger than the pattern of the top portion electrode 13 corresponding to the piezoelectric element 9. Then, the corresponding piezoelectric element 9 is accommodated in each housing recessed portion 52.

Figure 10:
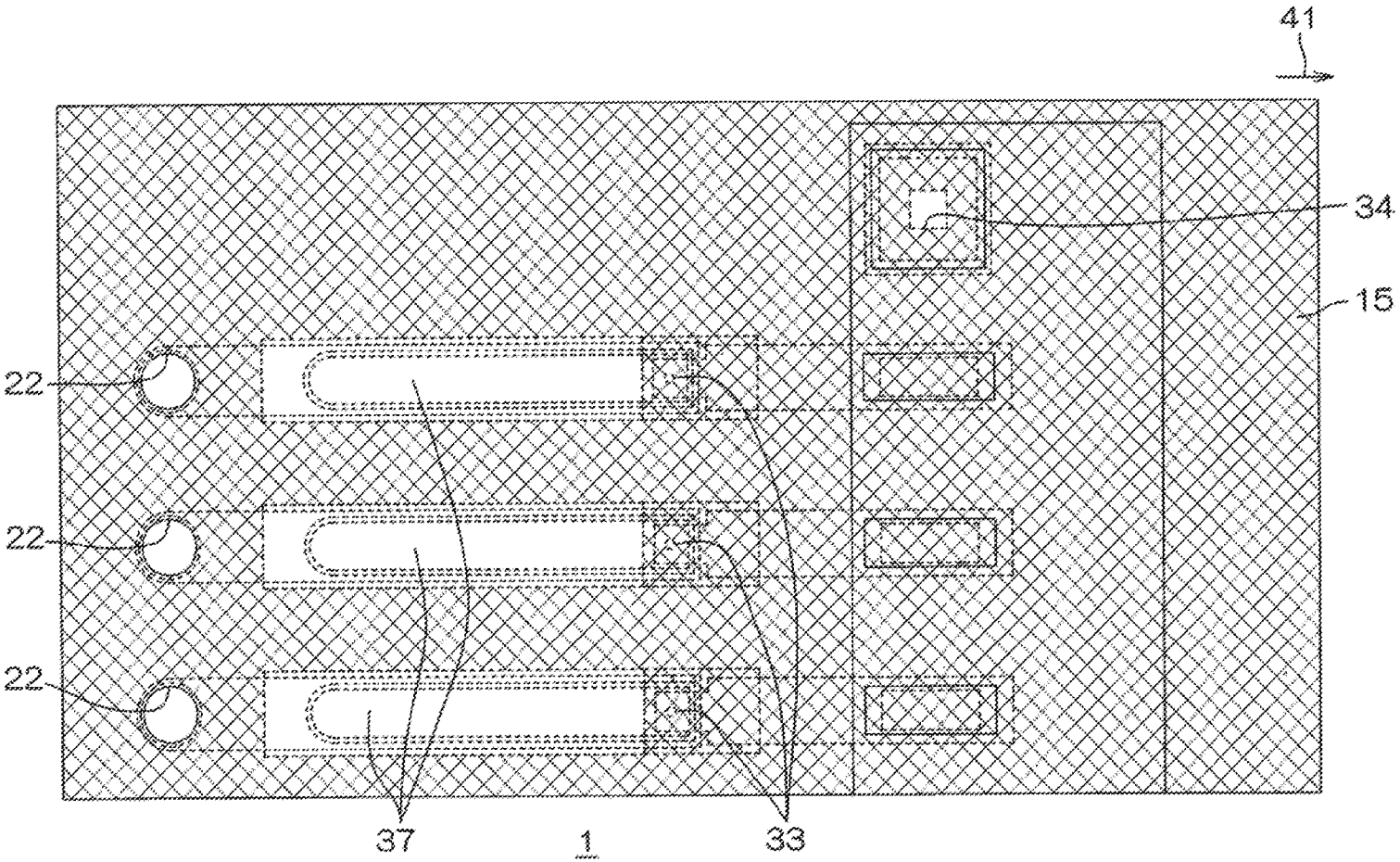
FIG. 10 is a schematic plan view of illustrating an exemplary pattern of an insulation film of the ink-jet print head, and is a plan view corresponding to FIG. 2.
Figure 11:
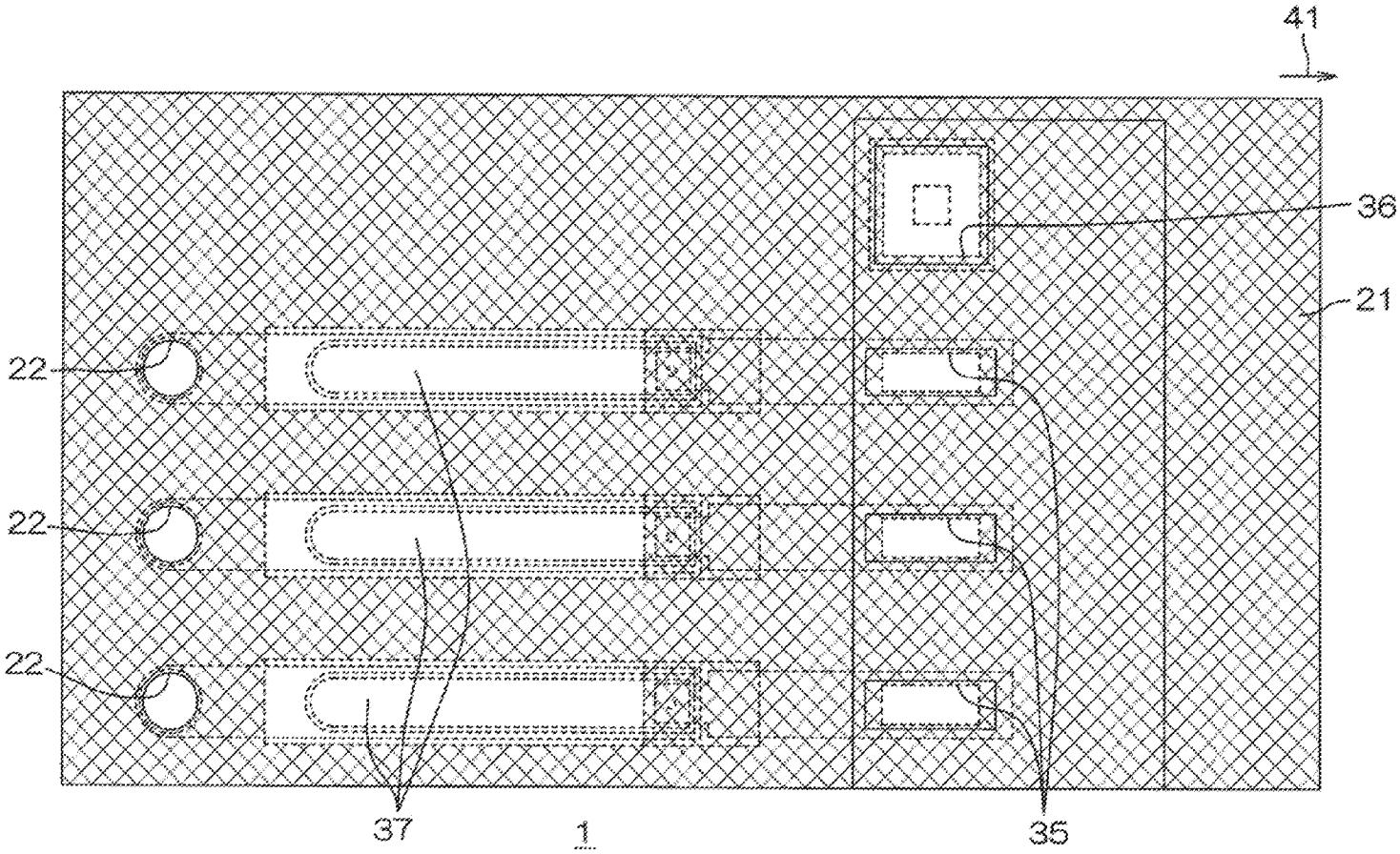
FIG. 11 is a schematic plan view of illustrating an exemplary pattern of a passivation film of the ink-jet print head, and is a plan view corresponding to FIG. 2.

FIG. 10 is a schematic plan view of illustrating an exemplary pattern of the insulation film of the ink-jet print head. FIG. 11 is a schematic plan view of illustrating an exemplary pattern of the passivation film of the ink-jet print head.

On the actuator substrate 2, the insulation film 15 and the passivation film 21 in the present embodiment are formed on approximately whole region of the outer side region of the housing recessed portion 52 of the protection substrate 4 in the plan view. It is noted, however, that the through hole for the ink supply 22 and the contact hole 34 are formed on the insulation film 15 in this region. In this region, the through hole for the ink supply 22, and the pad openings 35 and 36 are formed on the passivation film 21.

In the side region of the housing recessed portion 52 of the protection substrate 4, the insulation film 15 and the passivation film 21 may be formed only on one end portion (top portion wiring region) in which the top portion wiring 17 exists. In this region, the passivation film 21 is formed to cover the upper surface and the side surface of the top portion wiring 17 of the insulation film 15. In other words, an opening 37 is formed on the insulation film 15 and the passivation film 21 within the region of the side region of the housing recessed portion 52 other than the top portion wiring region in the plan view. On the insulation film 15, a contact hole 33 is further formed.

The summary of the method for producing the ink-jet print head 1 will be described.

Figure 13:
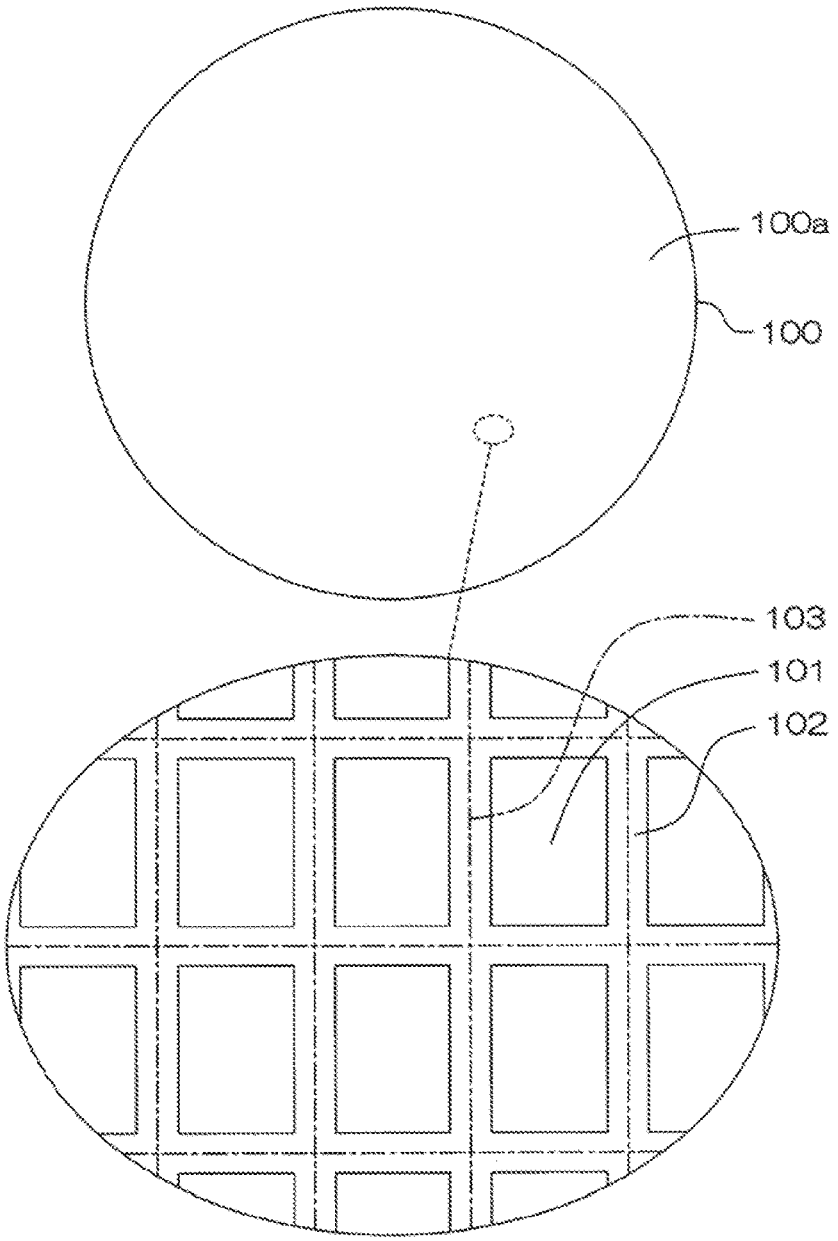
FIG. 13 is a plan view of a semiconductor wafer as an original substrate of an actuator substrate.

FIG. 13 is a plan view of a semiconductor wafer as an original substrate of an actuator substrate, and a partial region is enlarged.

A semiconductor wafer (actuator wafer) 100 as the original substrate of the actuator substrate 2 is, for example, consisted of a silicon wafer. A surface 100*a* of the actuator wafer 100 corresponds to the surface 2*a* of the actuator substrate. On the surface 100*a* of the actuator wafer 100, a plurality of functional-element forming regions 101 are arranged and set in a matrix. Between the adjacent functional-element forming regions 101, a scribing region (boundary region) 102 is disposed. The scribing region 102 is a belt-shaped region whose width is approximately constant, and is formed in a form of a grid extending in orthogonal two directions. On the scribing region 102, a scheduled cut line 103 is set. A necessary step is performed with respect to the actuator wafer 100 so as to prepare the substrate assembly aggregation (SA aggregation) 110 (see FIG. 14J), in which the ink flow path 5 is not formed but the configurations of the substrate assembly SA are formed on the respective functional-element forming regions 101.

A protection substrate aggregation 130 (see FIG. 14K) is prepared in advance that integrally includes a plurality of protection substrates 4 corresponding to the respective functional-element forming regions 101 of the substrate assembly aggregation 110. The protection substrate aggregation 130 is prepared by performing necessary steps with respect to the semiconductor wafer (wafer for the protection substrate) as the original substrate of the protection substrate 4. The wafer for the protection substrate is, for example, consisted of a silicon wafer.

In addition, a nozzle substrate aggregation 150 (see FIG. 14M and FIG. 15F) is prepared in advance that integrally includes a plurality of nozzle substrates 3 corresponding to the respective functional-element forming regions 101 of the substrate assembly aggregation 110. The nozzle substrate aggregation 150 is prepared by performing necessary steps with respect to the semiconductor wafer (nozzle wafer) as the original substrate of the nozzle substrate 3. The nozzle wafer is, for example, consisted of a silicon wafer. As illustrated in FIG. 14M and FIG. 15F, the nozzle substrate aggregation 150 is consisted of a nozzle wafer 140, an adhesion material film 141 being a material film of the adhesion layer 31 formed on one surface of the nozzle wafer 140, and a water repellent material film 142 being a material film of the water repellent film 32 formed on the surface of the adhesion material film 141.

When the substrate assembly aggregation 110 is prepared, the protection substrate aggregation 130 is joined to the substrate assembly aggregation 110. Next, the ink flow path 5 is formed on the substrate assembly aggregation 110. Next, the nozzle substrate aggregation 150 is joined to the substrate assembly aggregation 110. Thus, the ink-jet print head aggregation 170 (see FIG. 14M) is obtained that is consisted of the substrate assembly aggregation 110, the protection substrate aggregation 130, and the nozzle substrate aggregation 150. Then, the ink-jet print head aggregation 170 is cut (subjected to dicing) along the scheduled cut line 103 by a dicing blade. Thus, each of the individual ink-jet print heads (chips) 1 including the functional-element forming regions 101 are cut out. The ink-jet print head 1 includes the scribing region 102 at the circumference edge portion, and the functional-element forming region 101 at the center region surrounded by the scribing region 102.

In the following description, the method for producing the ink-jet print head 1 will be described in detail.

FIGS. 14A, 14B, 14C, 14D, 14E, 14F, 14G, 14H, 14I, 14J, 14K, 14L and 14M are transverse sectional views illustrating the production step of the ink-jet print head 1, and transverse sectional views corresponding to the cut surface of FIG. 4.

Figure 14A:
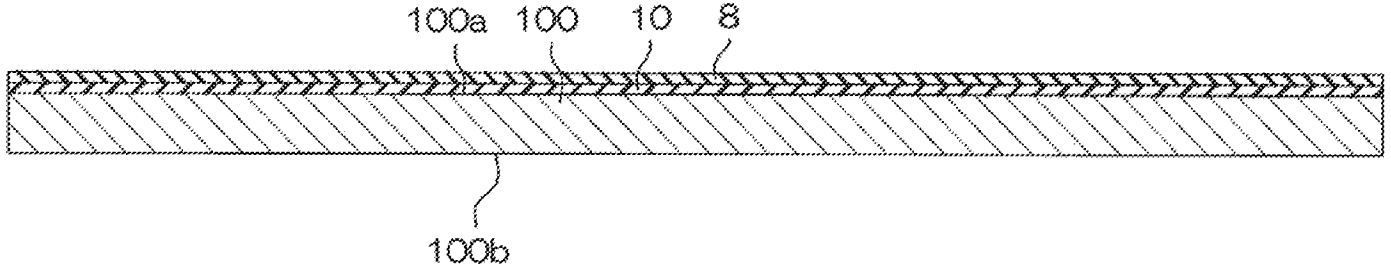
FIG. 14A is a transverse sectional view illustrating an example of a production step of the ink-jet print head.

First, the actuator wafer 100 is prepared as illustrated in FIG. 14A. It is noted, however, that the actuator wafer 100 thicker than the thickness of the final actuator substrate 2 is used. Then, the movable film form layer 10 is formed on the surface 100*a* of the actuator wafer 100. Specifically, a silicon oxide film (for example, 1.2 μm thickness) is formed on the surface 100*a* of the actuator wafer 100. In the case that the movable film form layer 10 is consisted of a stack film including a silicon film, a silicon oxide film, and a silicon nitride film, a silicon film (for example, 0.4 μm thickness) is formed on the surface of the actuator substrate 2, a silicon oxide film (for example, 0.4 μm thickness) is formed on the silicon film, and the silicon nitride film (for example, 0.4 μm thickness) is formed on the silicon oxide film.

Next, the metal barrier film 8 is formed on the movable film form layer 10. The metal barrier film 8 is, for example, consisted of an Al2O3 film (for example, 50 to 100 nm thickness). The metal barrier film 8 suppresses metal atoms from breaking out from the piezoelectric film 12 that is formed later. When the metal atoms breaks out, the piezoelectric property of the piezoelectric film 12 may be deteriorated. In addition, when the breaking-out metal atoms are contaminated in the silicon layer configuring the movable film 10A, the durability of the movable film 10A may be deteriorated.

Figure 14B:
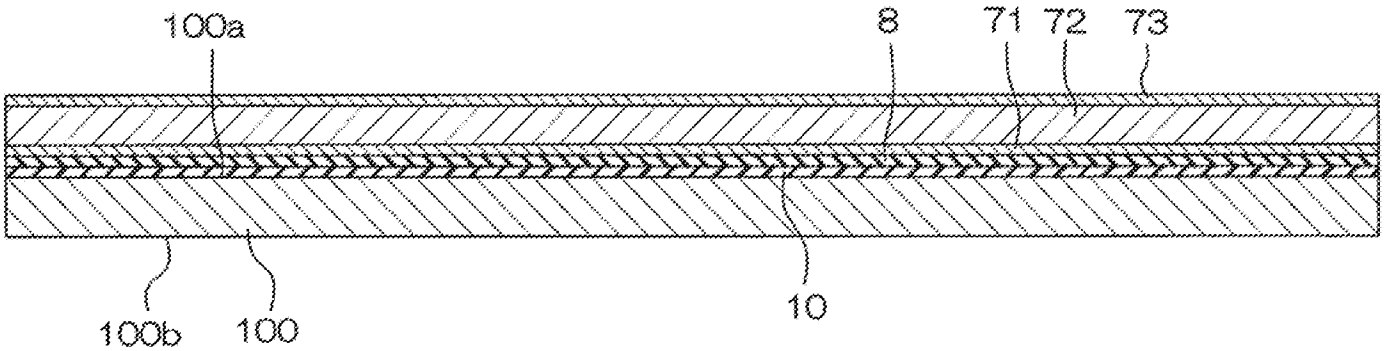
FIG. 14B is a transverse sectional view illustrating a next step of FIG. 14A.

Next, as illustrated in FIG. 14B, the bottom portion electrode film 71 being the material layer of the bottom portion electrode 11 is formed on the metal barrier film 8. The bottom portion electrode film 71 is, for example, consisted of a Pt/Ti stack film which includes a Ti film (for example, 10 to 40 nm thickness) as the bottom layer and a Pt film (for example, 10 to 400 nm thickness) as the top layer. This kind of the bottom portion electrode film 71 may also be formed by a spattering method.

Next, a piezoelectric material film 72 being a material of the piezoelectric film 12 is formed on the entire surface of the bottom portion electrode film 71. Specifically, for example, the piezoelectric material film 72 having 1 to 3 μm thickness is formed by a sol-gel method. This kind of the piezoelectric material film 72 is consisted of a sintered body of the metal oxide crystal grain.

Next, a top portion electrode film 73 being a material of the top portion electrode 13 is formed on the entire surface of the piezoelectric material film 72. The top portion electrode film 73 may be, for example, a single film of platinum (Pt). The top portion electrode film 73 may be, for example, an IrO2/Ir stack film which includes an IrO2 film (for example, 40 to 160 nm thickness) as the bottom layer and an Ir film (for example, 40 to 160 nm thickness) as the top layer. This kind of the top portion electrode film 73 may also be formed by a spattering method.

Figure 14C:
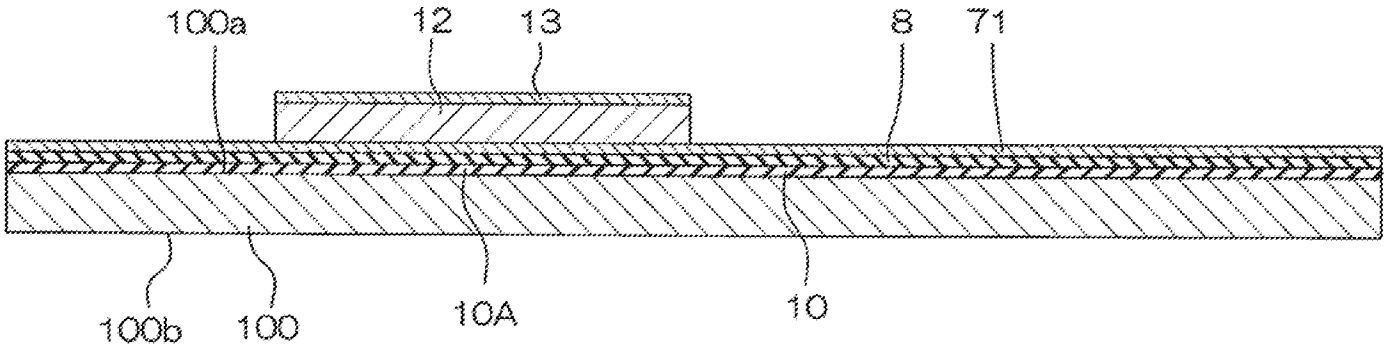
FIG. 14C is a transverse sectional view illustrating a next step of FIG. 14B.
Figure 14D:
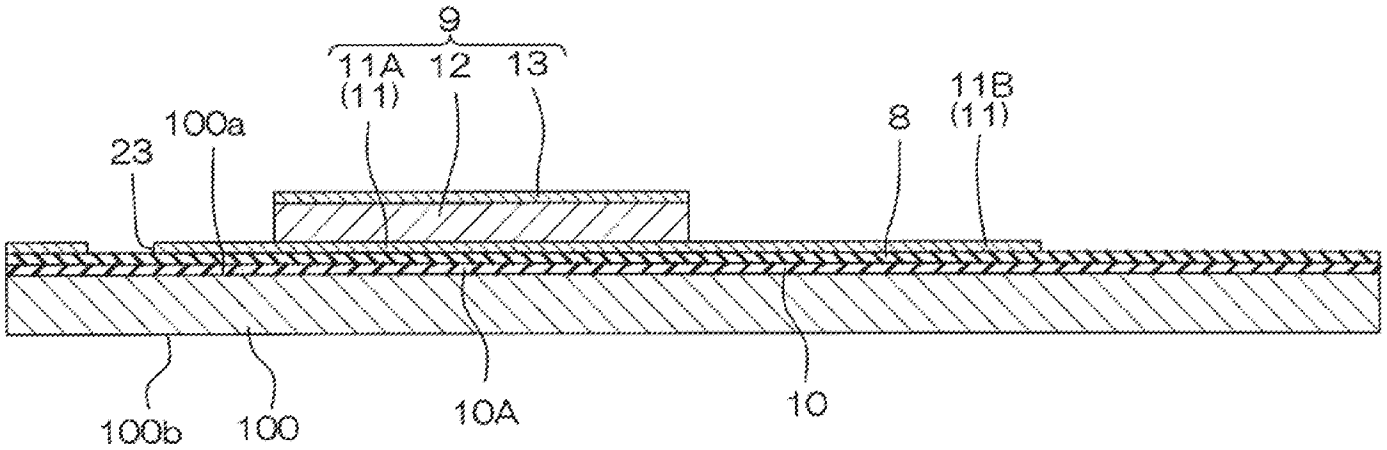
FIG. 14D is a transverse sectional view illustrating a next step of FIG. 14C.

Next, as illustrated in FIG. 14C and FIG. 14D, patternings of the top portion electrode film 73, the piezoelectric material film 72, and the bottom portion electrode film 71 are performed. First, by photolithography, the resist mask of the pattern of the top portion electrode 13 is formed. Then, as illustrated in FIG. 14C, this resist mask is used as the mask and thus the top portion electrode film 73 and the piezoelectric material film 72 are subjected to etching in sequence, so that predetermined patterns of the top portion electrode 13 and the piezoelectric film 12 are formed.

Next, after the resist mask is separated, the resist mask of the pattern of the bottom portion electrode 11 is formed by photolithography. Then, as illustrated in FIG. 14D, this resist mask is used as the mask and thus the bottom portion electrode film 71 is subjected to etching, so that a predetermined pattern of the bottom portion electrode 11 is formed. This ensures that, the bottom portion electrode 11 consisted of the main electrode portion 11A and the extending portion 11B including the through hole 23 is formed. Thus, the piezoelectric element 9 is formed that is consisted of the main electrode portion 11A of the bottom portion electrode 11, the piezoelectric film 12, and the top portion electrode 13.

Figure 14E:
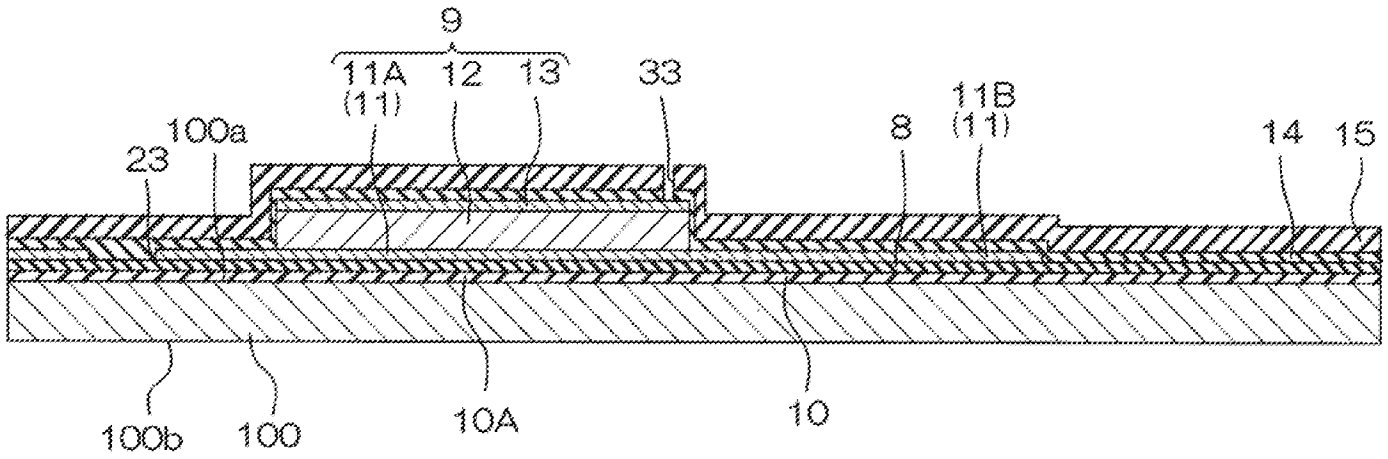
FIG. 14E is a transverse sectional view illustrating a next step of FIG. 14D.

Next, as illustrated in FIG. 14E, after the resist mask is separated, the hydrogen barrier film 14 covering the entire surface is formed. The hydrogen barrier film 14 may be an Al2O3 film formed by a spattering method, and the film thickness may be 50 to 100 nm. Then, the insulation film 15 is formed on the entire surface of the hydrogen barrier film 14. The insulation film 15 may be a SiO2 film, and the film thickness may be 200 to 300 nm. Next, the insulation film 15 and the hydrogen barrier film 14 are subjected to etching in sequence so as to form the contact holes 33 and 34.

Figure 14F:
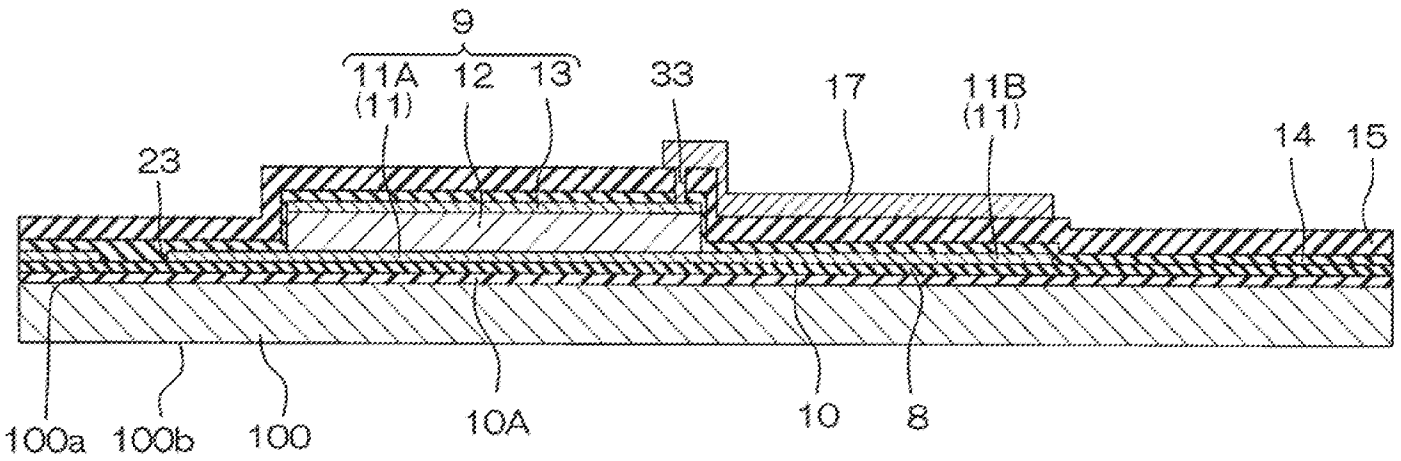
FIG. 14F is a transverse sectional view illustrating a next step of FIG. 14E.

Next, as illustrated in FIG. 14F, a wiring film configuring the top portion wiring 17 and the bottom portion wiring 18 is formed on the insulation film 15 including the insides of the contact holes 33 and 34 by a spattering method. Then, by photolithography and etching, the wiring film is subjected to patterning so that the top portion wiring 17 and the bottom portion wiring 18 are simultaneously formed.

Figure 14G:
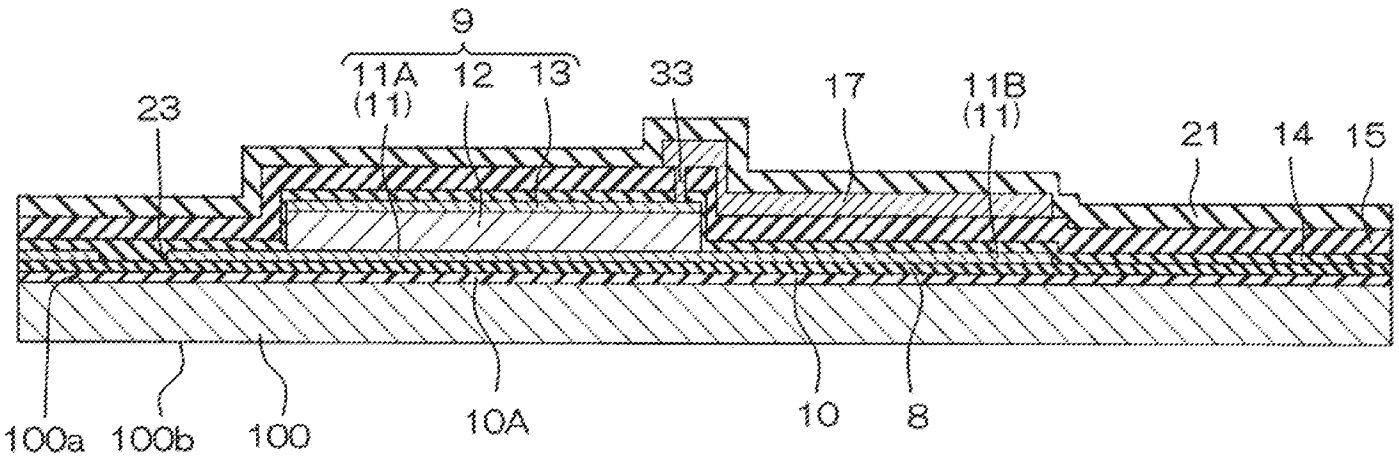
FIG. 14G is a transverse sectional view illustrating a next step of FIG. 14F.

Next, as illustrated in FIG. 14G, the passivation film 21 is formed on the surface of the insulation film 15 to cover the respective wirings 17 and 18. The passivation film 21 is, for example, made of SiN. The passivation film 21 is formed, for example, by plasma chemical vapor deposition (CVD).

Figure 14H:
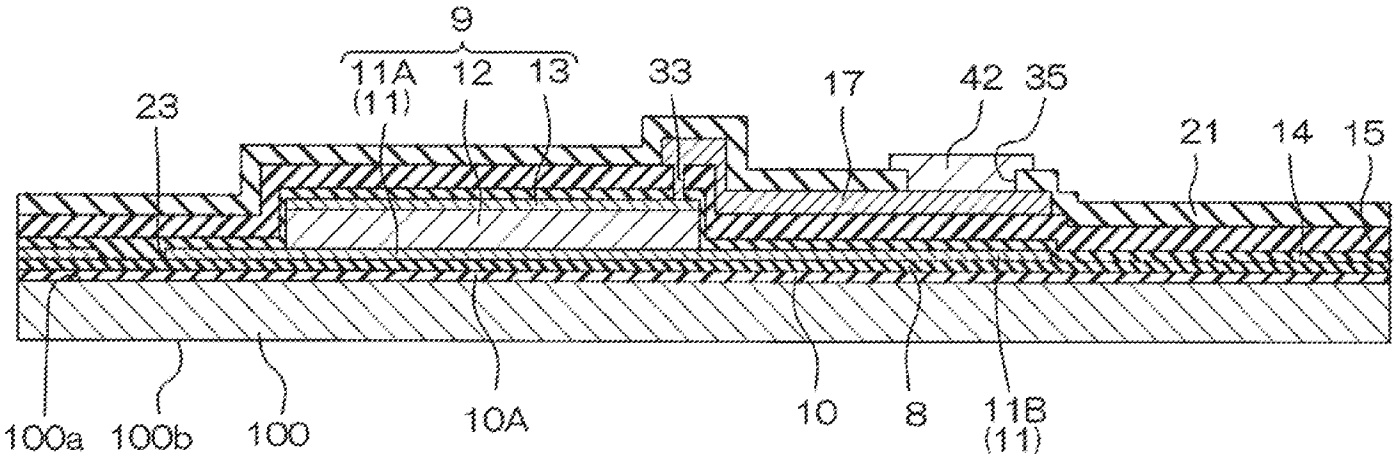
FIG. 14H is a transverse sectional view illustrating a next step of FIG. 14G.

Next, a resist mask including openings corresponding to the pad openings 35 and 36 is formed by photolithography, and this resist mask is used as the mask so that the passivation film 21 is subjected to etching. This ensures that, as illustrated in FIG. 14H, the pad openings 35 and 36 are formed on the passivation film 21. After the resist mask is separated, the pad for the top portion electrode 42 and the pad for the bottom portion electrode 43 are individually formed on the passivation film 21 through the pad openings 35 and 36.

Figure 14I:
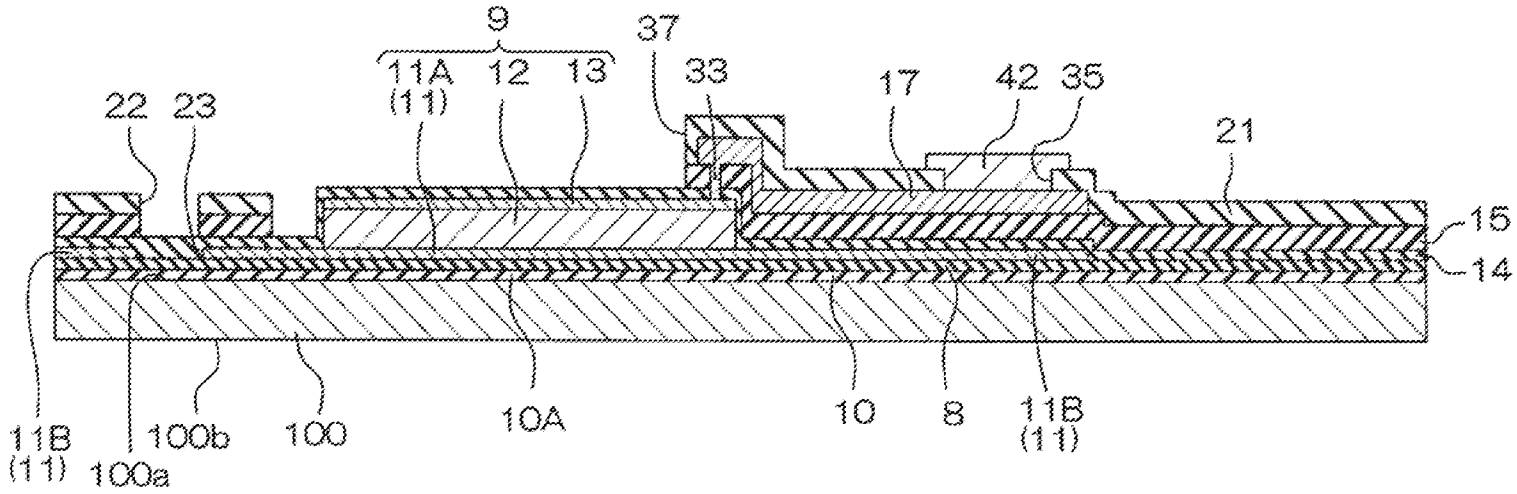
FIG. 14I is a transverse sectional view illustrating a next step of FIG. 14H.

Next, the resist mask including an opening corresponding to the opening 37 and the through hole for the ink supply 22 is formed by photolithography, and this the resist mask is used as the mask so that the passivation film 21 and the insulation film 15 are subjected to etching in sequence. This ensures that, as illustrated in FIG. 14I, the opening 37 and the through hole for the ink supply 22 are formed on the passivation film 21 and the insulation film 15.

Figure 14J:
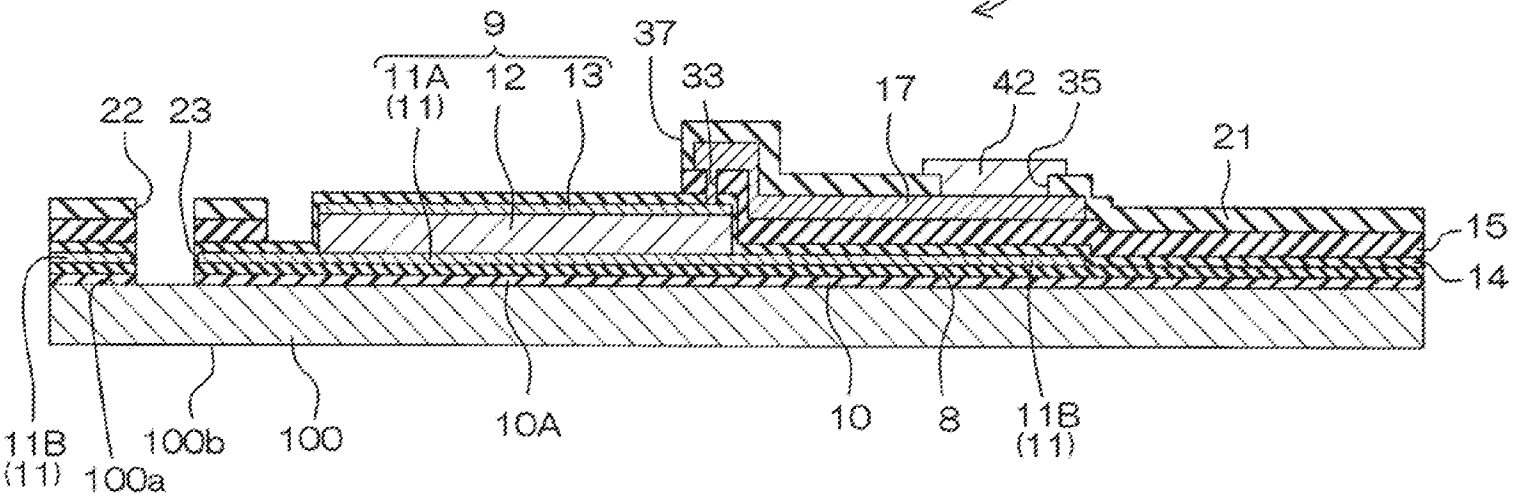
FIG. 14J is a transverse sectional view illustrating a next step of FIG. 14I.

Next, the resist mask is separated. Then, the resist mask including an opening corresponding to the through hole for the ink supply 22 is formed by photolithography, and this resist mask is used as the mask, so that the hydrogen barrier film 14, the metal barrier film 8, and the movable film form layer 10 are subjected to the etching. This ensures that, as illustrated in FIG. 14J, the through hole for the ink supply 22 is formed on the hydrogen barrier film 14, the metal barrier film 8, and the movable film form layer 10. This ensures that, the substrate assembly aggregation 110 is prepared.

Figure 14K:
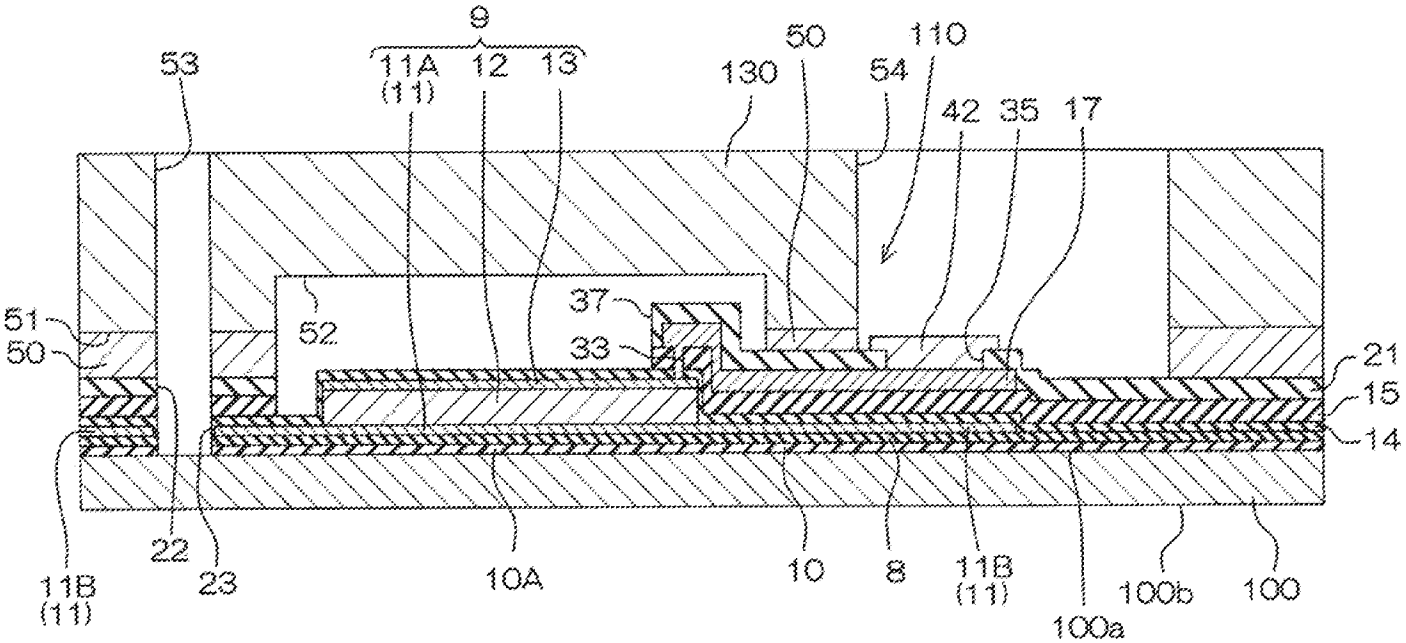
FIG. 14K is a transverse sectional view illustrating a next step of FIG. 14J.

Next, as illustrated in FIG. 14K, the adhesive agent 50 is applied to the facing surface 51 of the protection substrate aggregation 130, and the protection substrate aggregation 130 is secured to the substrate assembly aggregation 110 so that the ink supply path 53 matches the corresponding through hole for the ink supply 22.

Figure 14L:
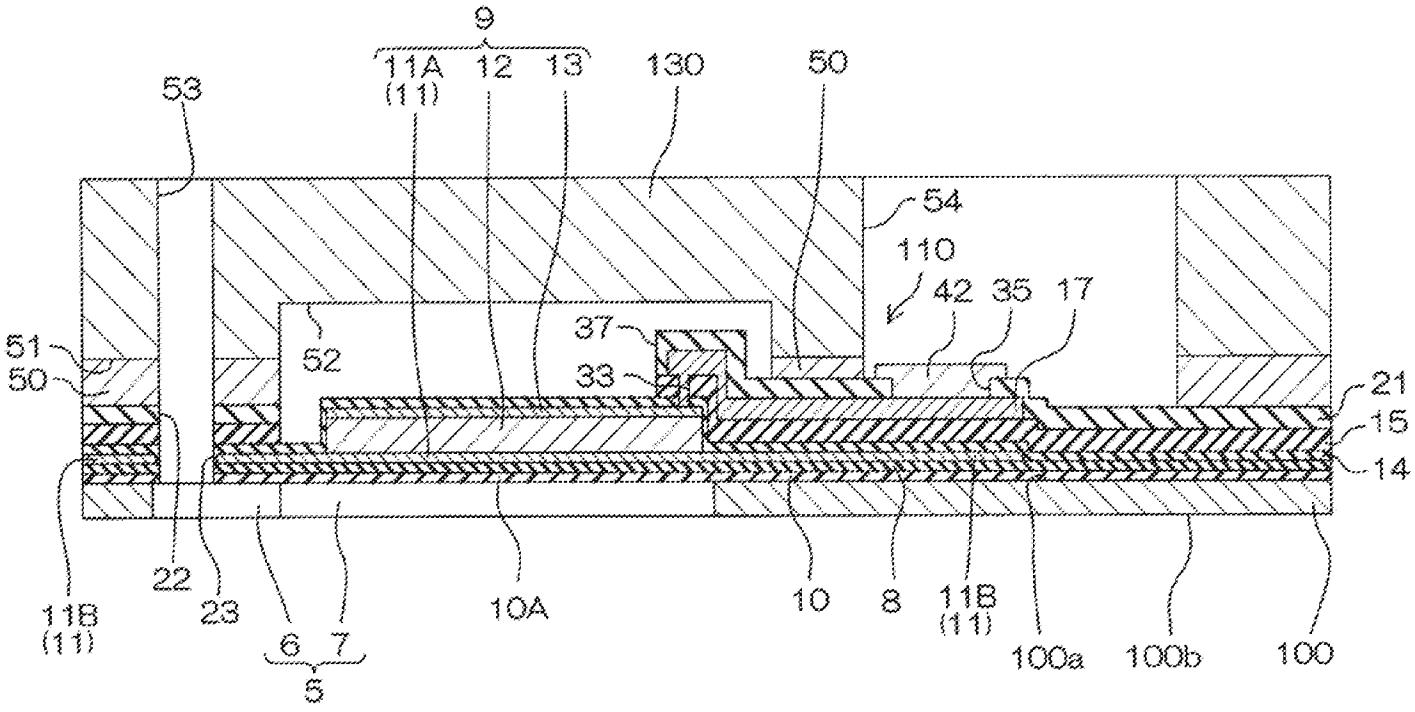
FIG. 14L is a transverse sectional view illustrating a next step of FIG. 14K.
Figure 14M:
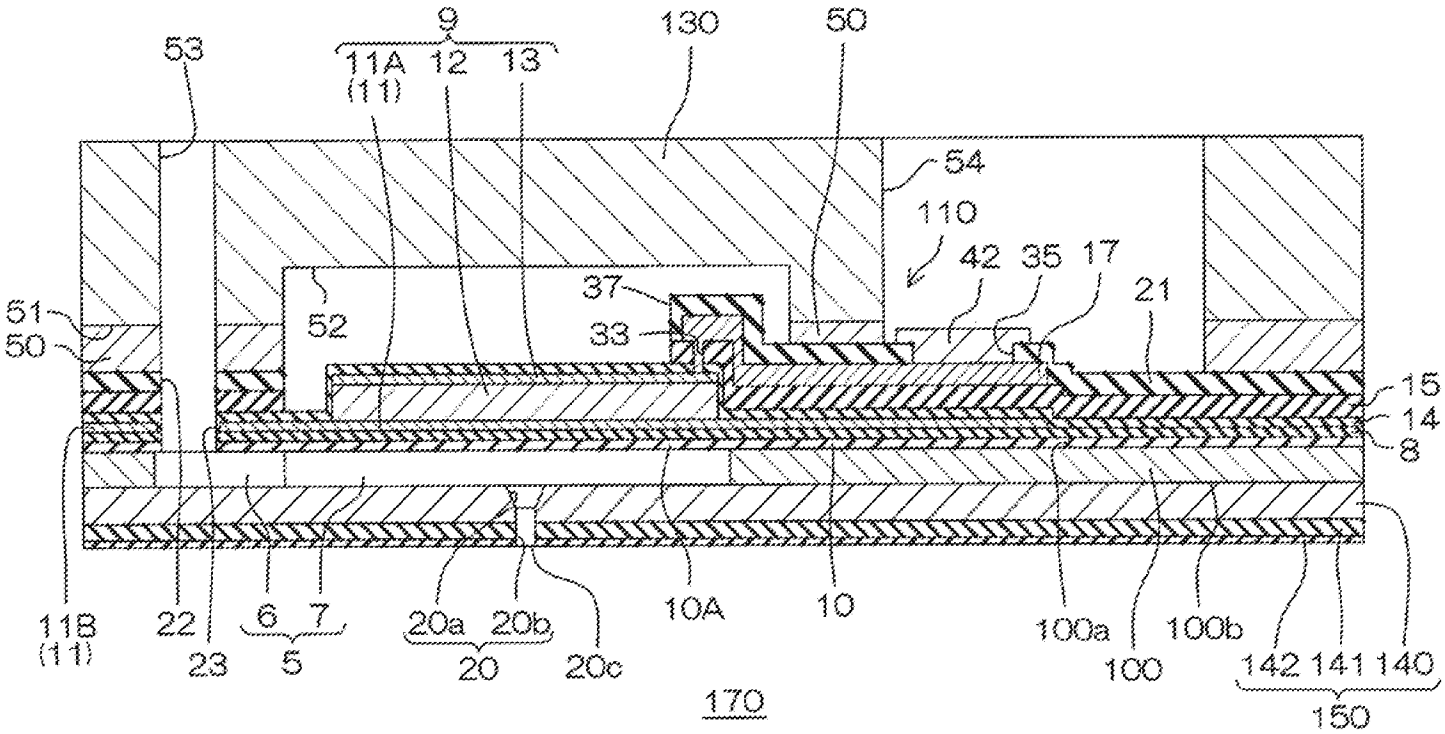
FIG. 14M is a transverse sectional view illustrating a next step of FIG. 14L.

Next, as illustrated in FIG. 14L, rear-surface grinding is performed to thin the actuator wafer 100. The actuator wafer 100 is polished from the rear surface 100*b*, so that the actuator wafer 100 is subjected to film thinning. For example, the actuator wafer 100 having approximately 670 μm thickness at the initial state may be thinned to have approximately 300 μm thickness. Then, the resist mask including the opening corresponding to the ink flow path 5 (ink inflowing portion 6 and pressure chamber 7) is formed at the rear surface 100*b* side of the actuator wafer 100 by photolithography, and this resist mask is used as the mask, so that the actuator wafer 100 is subjected to etching from the rear surface 100*b*. This ensures that, the ink flow path 5 (ink inflowing portion 6 and pressure chamber 7) is formed on the actuator wafer 100.

At the time of performing this etching, the metal barrier film 8 formed on the surface of the movable film form layer 10 suppresses metal elements (Pb, Zr, and Ti in the case of PZT) from breaking out from the piezoelectric film 12, so that the piezoelectric property of the piezoelectric film 12 is kept in a satisfactory manner. In addition, as described above, the metal barrier film 8 contributes to durability maintenance of the silicon layer forming the movable film 10A.

Then, as illustrated in FIG. 14M, the nozzle substrate aggregation 150 is stacked on the rear surface 100*b* of the actuator wafer 100. This ensures that, the ink-jet print head aggregation 170 is obtained that is consisted of the substrate assembly aggregation 110, the protection substrate aggregation 130, and the nozzle substrate aggregation 150. Then, the ink-jet print head aggregation 170 is cut along the scheduled cut line 103 by a dicing blade. That is, a step is performed to individually cut out the ink-jet print head 1.

When this step is completed, the actuator wafer 100 of the substrate assembly aggregation 110 becomes the actuator substrate 2 of the individual ink-jet print head 1. In addition, the protection substrate aggregation 130 becomes the protection substrate 4 of the individual ink-jet print head 1. In addition, the nozzle wafer 140, the adhesion material film 141, and the water repellent material film 142 of the nozzle substrate aggregation 150 become the silicon substrate 30, the adhesion layer 31, and the water repellent film 32 of the nozzle substrate 3 of the individual ink-jet print head 1, respectively. Thus, individual pieces of the ink-jet print head 1 of the structure illustrated in FIG. 1 to FIG. 9 are obtained.

On the ink-jet print head 1 obtained as described above, the side surface of the actuator substrate 2 and the side surface of the nozzle substrate 3 become flush in all directions in the plan view (flush over the entire periphery). That is, in the present embodiment, the ink-jet print head 1 is obtained that includes no level difference between the actuator substrate 2 and the nozzle substrate 3. In addition, in the present embodiment, the side surface of the actuator substrate 2 and the side surface of the protection substrate 4 also become flush in all directions in the plan view (flush over the entire periphery). That is, in the present embodiment, the ink-jet print head 1 is obtained that includes no level difference between the actuator substrate 2 and the protection substrate 4.

By the method in the present embodiment for producing the ink-jet print head, the nozzle substrate aggregation 150 is joined to the substrate assembly aggregation 110 to which the protection substrate aggregation 130 is secured, so as to prepare the ink-jet print head aggregation 170. Then, when the ink-jet print head aggregation 170 is subjected to dicing, the ink-jet print head 1 is individually cut out. Thus, it is possible to efficiently produce the ink-jet print head 1 as compared, for example, with the case where the individual substrate assembly SA is produced and then the nozzle substrate 3 is individually joined to the individual substrate assembly SA so as to produce the ink-jet print head.

FIGS. 15A, 15B, 15C, 15D, 15E and 15F are transverse sectional views schematically illustrating the production step of the nozzle substrate aggregation 150.

Figure 15A:
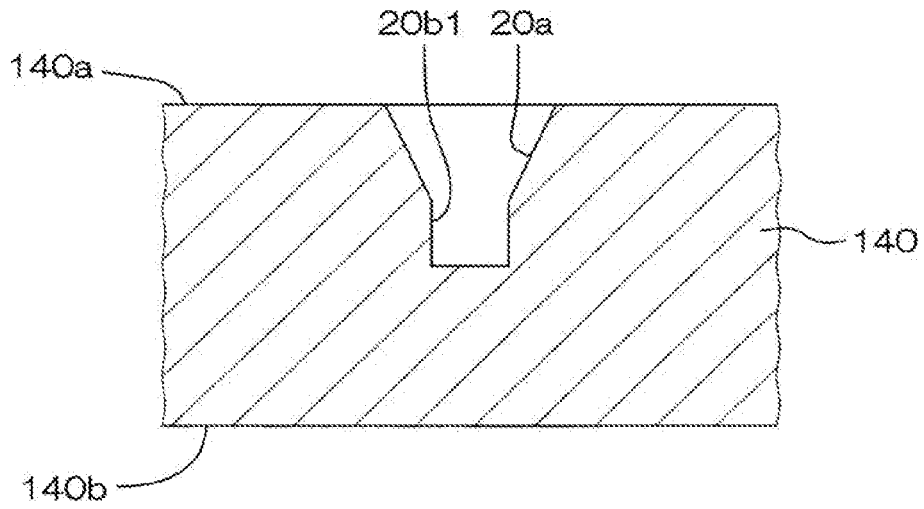
FIG. 15A is a transverse sectional view schematically illustrating a production step of a nozzle substrate aggregation.

First, as illustrated in FIG. 15A, the semiconductor wafer (nozzle wafer) 140 is prepared as the original substrate of the nozzle substrate 3. It is noted, however, that the nozzle wafer 140 thicker than the thickness of the final nozzle substrate 3 is used. The nozzle wafer 140 is consisted of a silicon wafer. The nozzle wafer 140 has a surface (first surface) 140*a* as the side facing to the rear surface 2*b* of the actuator substrate 2 and a rear surface (second surface) 140*b* at the opposite side.

By photolithography, the resist mask including an opening corresponding to the recessed part 20*a* is formed. This resist mask is used as the mask and thus the nozzle wafer 140 is subjected to etching, so that the recessed part 20*a* is formed on the first surface 140*a* of the nozzle wafer 140 and the first ink ejecting path 20*b*1 is formed on the bottom surface of the recessed part 20*a*. Specifically, at first, the recessed part 20*a* having a truncated cone shape is formed by the isotropic etching. Then, the first ink ejecting path 20*b*1 having a solid cylindrical shape is formed until the intermediate portion of the thickness of the nozzle wafer 140 by anisotropic etching. Then, the resist mask is removed.

Figure 15B:
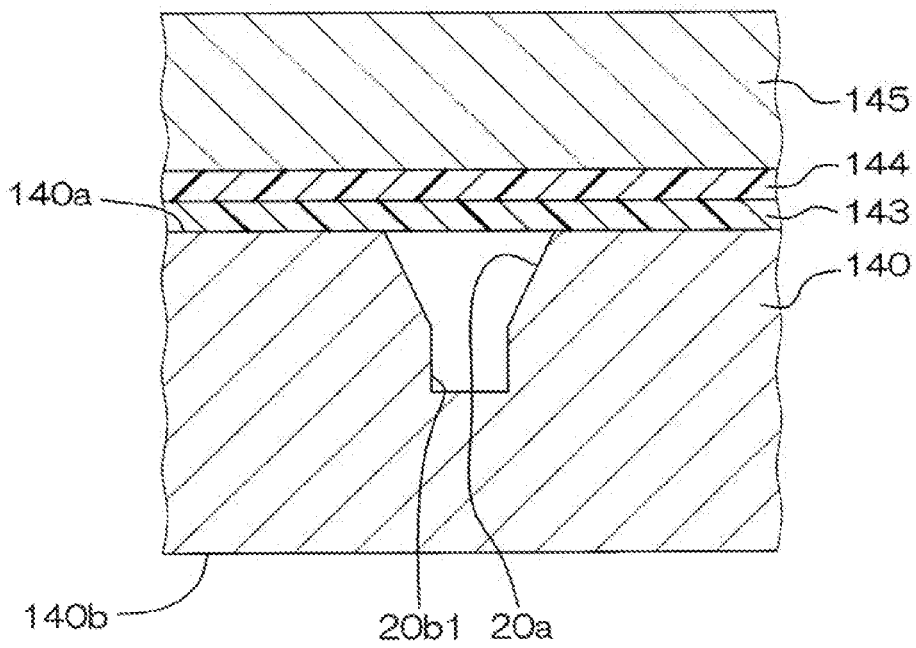
FIG. 15B is a transverse sectional view illustrating a next step of FIG. 15A.

Next, as illustrated in FIG. 15B, a first support wafer 145 is pasted on the first surface 140*a* of the nozzle wafer 140 through a first heat-resistant protection tape 143 and a first heat separation tape 144. The first heat-resistant protection tape 143 is, for example, a kapton (registered trademark) tape in which silicone system gluing agent is applied to polyimide. The first heat separation tape 144 is a tape separated in response to heat addition, and is consisted of, for example, a heat foaming separation gluing tape including foaming agent. In the present embodiment, the first heat separation tape 144 is consisted of a heat foaming separation gluing tape in which heat-response foaming occurs at 90° C. to 120° C. The first support wafer 145 is, for example, consisted of a silicon wafer whose thickness is approximately 400 μm.

Figure 15C:
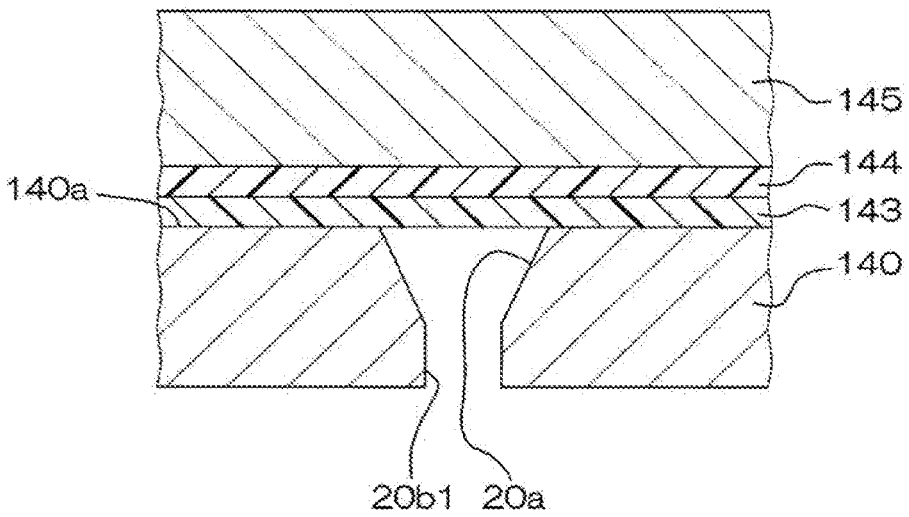
FIG. 15C is a transverse sectional view illustrating a next step of FIG. 15B.

Next, as illustrated in FIG. 15C, the nozzle wafer 140 is polished from the second surface 140*b* side so that the nozzle wafer 140 is subjected to film thinning. At this polishing, for example, the nozzle wafer 140 having 625 μm thickness at the initial state may be subjected to thinning to have approximately 50 μm thickness. This thinning brings a state that the first ink ejecting path 20*b*1 penetrates the bottom wall of the recessed part 20*a* of the nozzle wafer 140. It is preferable that, before film thinning of the nozzle wafer 140 or after the film thinning, a processing is performed for removing gas in the first heat separation tape 144 (outgas processing) by carrying out a heat processing at not less than 60° C. for approximately one hour or by carrying out vacuum drawing at not more than 3 [Torr] for approximately one hour.

Figure 15D:
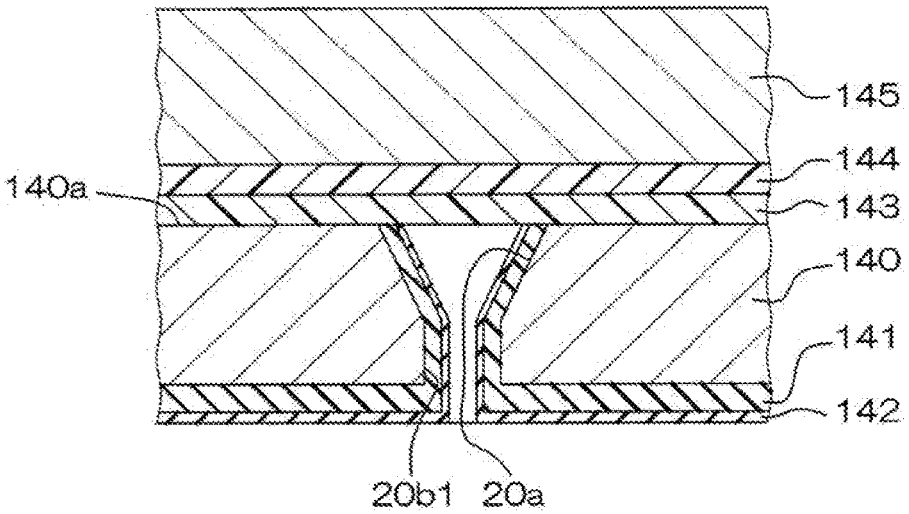
FIG. 15D is a transverse sectional view illustrating a next step of FIG. 15C.

Next, as illustrated in FIG. 15D, the adhesion material film 141 being a material film of the adhesion layer 31 and the water repellent material film 142 being a material film of the water repellent film 32 are sequentially formed on the opposite side surface to the first support wafer 145 side of the nozzle wafer 140 and on the exposed surface including the inner surfaces (side surfaces) of the recessed part 20*a* and the first ink ejecting path 20*b*1. Formation of these material films 141 and 142 is performed by, for example, CVD. Formation of these material films 141 and 142 may be performed by molecular vapor deposition (MCV) (registered trademark), which is one of the CVD methods. In the present embodiment, BTCSE (trichlorosilyl ethane) gas is used for the formation of the adhesion material film 141, and FDTS (perfluorodecyltrichlorosilane) gas is used for the formation of the water repellent material film 142.

Figure 15E:
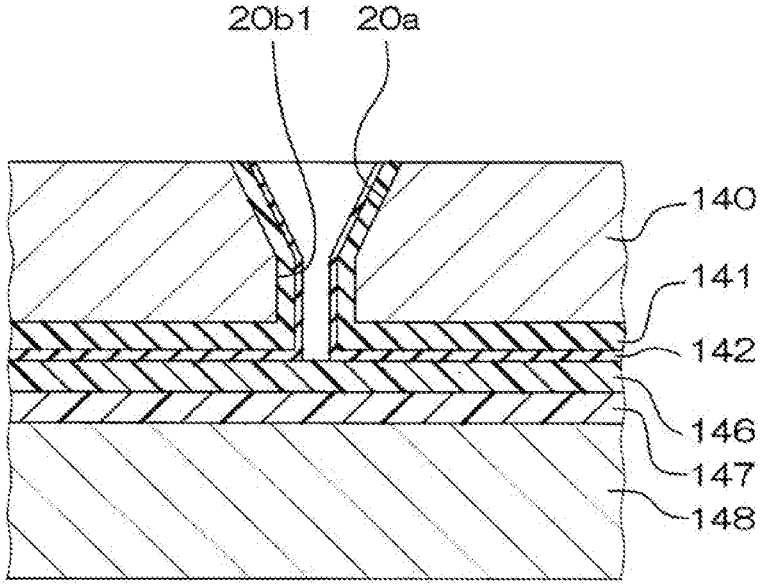
FIG. 15E is a transverse sectional view illustrating a next step of FIG. 15D.
Figure 15F:
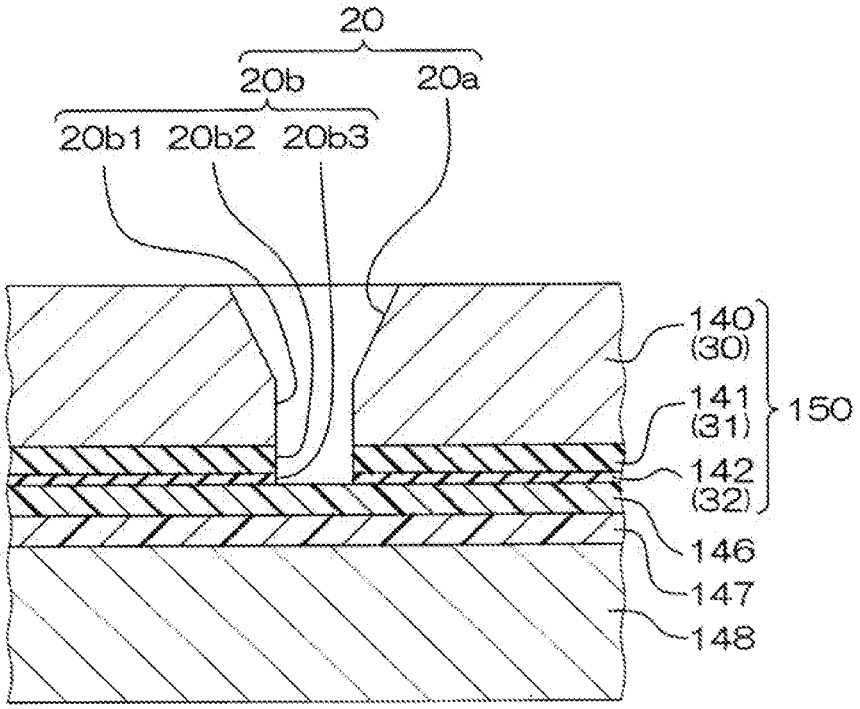
FIG. 15F is a transverse sectional view illustrating a next step of FIG. 15E.

Next, as illustrated in FIG. 15E, a second support wafer 148 is pasted on the surface of the water repellent material film 142 through a second heat-resistant protection tape 146 and a second heat separation tape 147. The second heat-resistant protection tape 146 is, for example, a kapton (registered trademark) tape. The second heat separation tape 147 is a tape separated in response to heat addition, and is consisted of, for example, a heat foaming separation gluing tape including foaming agent. In the present embodiment, the second heat separation tape 147 is consisted of a heat foaming separation gluing tape in which heat-response foaming occurs at 150° C. to 170° C. The second support wafer 148 is consisted of a silicon wafer whose thickness is, for example, approximately 400 μm.

Then, the first support wafer 145 is separated from the nozzle wafer 140. Specifically, by inducing heat-response foaming on the foaming agent in the first heat separation tape 144, the first support wafer 145 with the first heat separation tape 144 is separated from the first heat-resistant protection tape 143, and then the first heat-resistant protection tape 143 is separated from the nozzle wafer 140.

Next, as illustrated in FIG. 15F, oxygen plasma ashing is performed. The stage temperature at this oxygen plasma ashing time is set to be temperature (for example, equal to or less than 15° C.) at which the no heat-response foaming occurs on the second heat separation tape 147. This ensures that, gluing agent remaining on the separation surface (first surface 140*a* of the nozzle wafer 140) of the first heat-resistant protection tape 143 is removed, and that the material films 141 and 142 formed on the inner surfaces (side surfaces) of the recessed part 20*a* and the first ink ejecting path 20*b*1 are removed. This ensures that, the second ink ejecting path 20*b*2 connected to the first ink ejecting path 20*b*1 is formed on the adhesion material film 141 which is on the opposite side surface to the first surface 140*a* of the nozzle wafer 140. In addition, the third ink ejecting path 20*b*3 connected to the second ink ejecting path 20*b*2 is formed on the water repellent material film 142 over the adhesion material film 141.

The transverse sectional area of the third ink ejecting path 20*b*3 formed as described above is approximately equal to the size of the transverse sectional area of the first ink ejecting path 20*b*1. In addition, the inner circumference surface of the third ink ejecting path 20*b*3 is approximately perpendicular to the surface of the silicon substrate 30 (actuator substrate 2 side surface, and rear surface at the opposite side). The ink ejecting path 20*b* is configured with the first ink ejecting path 20*b*1, the second ink ejecting path 20*b*2, and the third ink ejecting path 20*b*3. Then, the nozzle hole 20 is configured with the recessed part 20*a* and the ink ejecting path 20*b*. The stack film consisted of the nozzle wafer 140, the adhesion material film 141, and the water repellent material film 142 configures a nozzle substrate aggregation 150. Thus, the nozzle substrate aggregation 150 with the second support wafer 148 is obtained that is consisted of the nozzle substrate aggregation 150 and the second support wafer 148 pasted on the nozzle substrate aggregation 150 through the second heat-resistant protection tape 146 and the second heat separation tape 147.

The nozzle substrate aggregation 150 with the second support wafer 148 obtained as described above is pasted on a rear surface 100*b* of the actuator wafer 100 of the substrate assembly aggregation 110. Then, the second heat-resistant protection tape 146, the second heat separation tape 147, and the second support wafer 148 are separated from the nozzle substrate aggregation 150.

Figure 16:
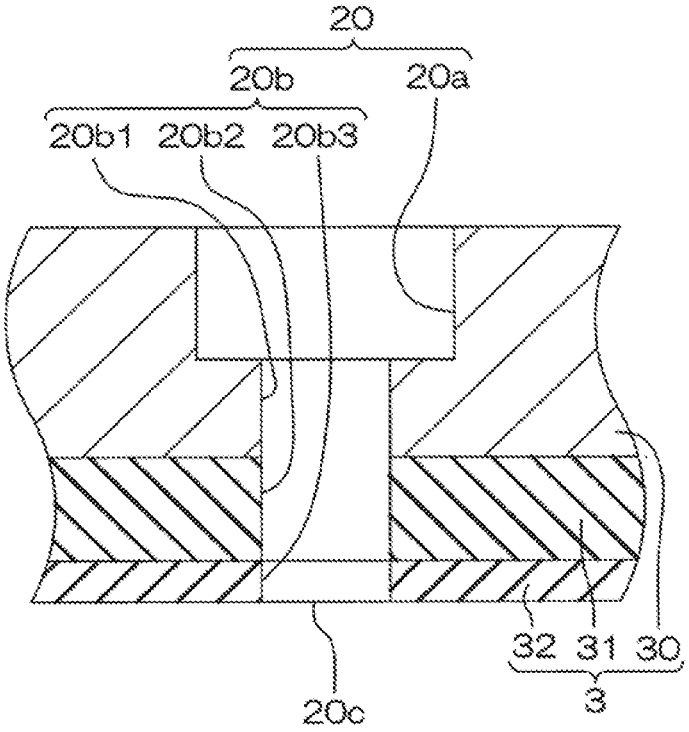
FIG. 16 is a transverse-sectional view illustrating an alternative example of the recessed part of the nozzle hole.

While the embodiment of the present disclosure is described above, the present disclosure may be further implemented in another embodiment. In the embodiment described above, the recessed part 20*a* is formed to have the truncated cone shape whose transverse section is gradually reduced in size from the surface of the silicon substrate 30 to the adhesion layer 31 side. However, as illustrated in FIG. 16, the recessed part 20*a* may be a straight hole whose transverse section is circular in the length direction. In other words, the recessed part 20*a* may have a solid cylindrical shape. It is noted that FIG. 16 is a transverse-sectional view corresponding to the cut surface of FIG. 5.

In addition, while two rows of the piezoelectric element arrays (pressure chamber arrays) are disposed on the actuator substrate 2, one row of the piezoelectric element array (pressure chamber array) may be disposed or not less than 3 rows of the piezoelectric element arrays (pressure chamber arrays) may be disposed.

In addition, while the insulation film 15 is formed on the partial surface of the hydrogen barrier film 14 in the embodiment described above, the insulation film 15 may be formed on the entire region of the surface of the hydrogen barrier film 14.

In addition, while the insulation film 15 is formed on the partial surface of the hydrogen barrier film 14 in the embodiment described above, the insulation film 15 may not be disposed.

In addition, while PZT was described as the material of the piezoelectric film in the embodiment described above, a piezoelectric material may be applied that is consisted of metallic oxide represented by lead titanate (PbPO3), potassium niobate (KNbO3), lithium niobate (LiNbO3), lithium tantalate (LiTaO3), and the like.

About the other things, it is possible to accept various design change within the range of matters recited in claims.

The present disclosure contains subject matter related to that disclosed in Japanese Priority Patent Application JP 2016-231797 filed in the Japan Patent Office on Nov. 29, 2016, the entire content of which is hereby incorporated by reference.

It should be understood by those skilled in the art that various modifications, combinations, sub-combinations and alterations may occur depending on design requirements and other factors insofar as they are within the scope of the appended claims or the equivalent thereof.

What is claimed is:

1. A nozzle substrate, comprising:

a main substrate including a first surface and a second surface;

an adhesion layer formed on the second surface of the main substrate; and a water repellent film formed on a surface of the adhesion layer, wherein:

the surface of the adhesion layer is at an opposite side to a main substrate side of the adhesion layer, the nozzle substrate includes a nozzle hole that penetrates in a thickness direction of the nozzle substrate, the nozzle hole includes a recessed part formed on the first surface of the main substrate, and an ink ejecting path formed on a bottom surface of the recessed part and penetrating a bottom wall of the recessed part, the ink ejecting path includes a first ink ejecting path penetrating the bottom wall of the recessed part of the main substrate, a second ink ejecting path connected to the first ink ejecting path and penetrating the adhesion layer, and a third ink ejecting path connected to the second ink ejecting path and penetrating the water repellent film, a transverse sectional area of the third ink ejecting path is approximately equal to a transverse sectional area of the first ink ejecting path, an inner circumference surface of the third ink ejecting path is approximately perpendicular to the second surface of the main substrate, and the inner circumference surface of the third ink ejecting path formed on the water repellent film is, in a plan view, depressed to an outside with respect to an inner circumference surface of the first ink ejecting path formed on the main substrate, and a depression amount thereof is equal to or less than 1.5 μm.

2. The nozzle substrate according to claim 1, wherein the recessed part has a truncated cone shape whose transverse section is gradually reduced in size from the first surface side to the second surface side of the main substrate.

3. The nozzle substrate according to claim 1, wherein the recessed part has a solid cylindrical shape.

4. The nozzle substrate according to claim 1, wherein the main substrate is a silicon substrate, the adhesion layer is a SiOC layer, and the water repellent film is made of an FDTS film.

5. An ink-jet print head, comprising:

an actuator substrate including an ink flow path with a pressure chamber;

a movable film form layer including a movable film disposed on the pressure chamber and defining a top surface portion of the pressure chamber;

a piezoelectric element formed on the movable film; and a nozzle substrate joined to an opposite side surface to a surface of the movable film side of the actuator substrate, defining a bottom surface portion of the pressure chamber, and including a nozzle hole connected to the pressure chamber, the nozzle substrate including the nozzle hole penetrating in a thickness direction, the nozzle substrate including a main substrate including a first surface and a second surface, an adhesion layer formed on the second surface of the main substrate, and a water repellent film formed on a surface of the adhesion layer, wherein:

the surface of the adhesion layer is at an opposite side to a main substrate side of the adhesion layer, the nozzle substrate includes a nozzle hole that penetrates in a thickness direction of the nozzle substrate, the nozzle hole including a recessed part formed on the first surface of the main substrate, and an ink ejecting path formed on a bottom surface of the recessed part and penetrating a bottom wall of the recessed part, the ink ejecting path including a first ink ejecting path penetrating the bottom wall of the recessed part of the main substrate, a second ink ejecting path connected to the first ink ejecting path and penetrating the adhesion layer, and a third ink ejecting path connected to the second ink ejecting path and penetrating the water repellent film, a transverse sectional area of the third ink ejecting path being approximately equal to a transverse sectional area of the first ink ejecting path, an inner circumference surface of the third ink ejecting path being approximately perpendicular to the second surface of the main substrate, wherein the first surface of the main substrate is joined to the opposite side surface to the surface of the movable film side of the actuator substrate, and the inner circumference surface of the third ink ejecting path formed on the water repellent film is, in a plan view, depressed to an outside with respect to an inner circumference surface of the first ink ejecting path formed on the main substrate, and a depression amount thereof is equal to or less than 1.5 μm.

6. The ink-jet print head according to claim 5, further comprising:

a protection substrate joined to the actuator substrate so as to cover the piezoelectric element, wherein the protection substrate includes a housing recessed portion opened toward the actuator substrate side and accommodating the piezoelectric element, and an ink supply path formed outside of one end of the housing recessed portion in the plan view and connected to one end portion of the ink flow path.

* * * * *